US010195855B2

(12) United States Patent
Nakata et al.

(10) Patent No.: US 10,195,855 B2
(45) Date of Patent: Feb. 5, 2019

(54) CAPPING DEVICE AND LIQUID EJECTING APPARATUS

(71) Applicant: SEIKO EPSON CORPORATION, Tokyo (JP)

(72) Inventors: Toshio Nakata, Matsumoto (JP); Ryoji Fujimori, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/656,841

(22) Filed: Jul. 21, 2017

(65) Prior Publication Data

US 2018/0029368 A1 Feb. 1, 2018

(30) Foreign Application Priority Data

Jul. 29, 2016 (JP) ..... 2016-150173

(51) Int. Cl.
*B41J 2/165* (2006.01)

(52) U.S. Cl.
CPC ..... *B41J 2/16505* (2013.01); *B41J 2/165* (2013.01); *B41J 2/16508* (2013.01); *B41J 2/16517* (2013.01)

(58) Field of Classification Search
CPC ..... B41J 2/16505; B41J 2/16508; B41J 2/16511; B41J 2/16517; B41J 2/16523; B41J 2/16526; B41J 2/16532; B41J 2/16535; B41J 2/16541; B41J 2002/1655
See application file for complete search history.

(56) References Cited

U.S. PATENT DOCUMENTS

| | | | | |
|---|---|---|---|---|
| 4,947,187 | A | 8/1990 | Iwagami | |
| 2008/0030540 | A1 | 2/2008 | Suzuki | |
| 2009/0109257 | A1 | 4/2009 | Shimazaki | |
| 2011/0227998 | A1 * | 9/2011 | Kamiyama | B41J 2/16552 347/29 |

FOREIGN PATENT DOCUMENTS

| | | | |
|---|---|---|---|
| JP | 63-221047 | A | 9/1988 |
| JP | 01-005852 | A | 1/1989 |
| JP | 02-200445 | A | 8/1990 |
| JP | 07-032601 | A | 2/1995 |
| JP | 07-186405 | A | 7/1995 |
| JP | 08-150734 | A | 6/1996 |
| JP | 11-268294 | A | 10/1999 |
| JP | 2006-130659 | A | 5/2006 |
| JP | 2009-101634 | A | 5/2009 |

* cited by examiner

*Primary Examiner* — Juanita D Jackson
(74) *Attorney, Agent, or Firm* — Workman Nydegger

(57) ABSTRACT

A capping device includes a moisturizing cap which is brought into contact with a liquid ejecting unit configured to eject a liquid from a nozzle so as to allow forming of a space including the nozzle, a connection flow channel which is connected to the moisturizing cap, and a moisturizing liquid supply unit which is connected to the connection flow channel, includes a moisturizing liquid storage unit configured to allow storing of a moisturizing liquid, and allows a supply of the moisturizing liquid to the moisturizing liquid storage unit so as to cause a liquid surface of the moisturizing liquid in the moisturizing liquid storage unit to be a first position. The moisturizing cap includes an atmospheric communication portion configured to open the space to an atmosphere.

11 Claims, 18 Drawing Sheets

CAPPING DEVICE AND LIQUID EJECTING APPARATUS

BACKGROUND

1. Technical Field

The present invention relates to a capping device for moisturizing a liquid ejecting unit configured to eject a liquid, and a liquid ejecting apparatus including the same.

2. Related Art

In the related art, a liquid ejecting apparatus such as an ink jet printer in which a liquid such as an ink is ejected from a nozzle provided in a liquid ejecting unit such as a head, so as to perform recording on a medium is known. Among printers which perform in this manner, a printer which includes a moisturizing cap for moisturizing the head in order to suppress solidification of an ink in the nozzle occurring by drying is provided (for example, JP-A-2009-101634). The moisturizing cap disclosed in JP-A-2009-101634 includes an absorption material for holding moisture. Stored water is supplied to the moisturizing cap from a water tank through a tube by a water head difference. Thus, the moisturizing cap is brought into contact with the head so as to form a closed space including a nozzle, and the closed space is moisturized by moisture held by the absorption material.

In the printer disclosed in JP-A-2009-101634, for example, if the temperature of the vicinity of the moisturizing cap is increased, a gas such as an air in the closed space including the nozzle is expanded. Thus, air pressure in the closed space is increased. If the air pressure in the closed space is increased, a gas in the nozzle flows, and thus the meniscus of an ink in the nozzle may be broken, and this may influence characteristics of the nozzle.

SUMMARY

An advantage of some aspects of the invention is to provide a capping device which can suitably moisturize a liquid ejecting unit configured to eject a liquid, and a liquid ejecting apparatus including the capping device.

Hereinafter, means of the invention and operation effects thereof will be described.

According to an aspect of the invention, there is provided a capping device which includes a moisturizing cap which is brought into contact with a liquid ejecting unit configured to eject a liquid from a nozzle so as to allow forming of a space including the nozzle, a connection flow channel which is connected to the moisturizing cap, and a moisturizing liquid supply unit which is connected to the connection flow channel, includes a moisturizing liquid storage unit configured to allow storing of a moisturizing liquid, and allows a supply of the moisturizing liquid to the moisturizing liquid storage unit so as to cause a liquid surface of the moisturizing liquid in the moisturizing liquid storage unit to be a first position. The moisturizing cap includes an atmospheric communication portion configured to open the space to an atmosphere.

According to the configuration, for example, even though the temperature of the surrounding is increased and thus a gas in a space formed by the moisturizing cap is expanded, a probability of damaging the meniscus of an ink in the nozzle is reduced because the space communicates with an atmosphere by the atmospheric communication portion. Accordingly, it is possible to suitably moisturize the liquid ejecting unit configured to eject a liquid.

In the capping device, preferably, the moisturizing liquid supply unit supplies the moisturizing liquid to the moisturizing liquid storage unit so as to cause the first position to be lower than that of the space in a vertical direction.

According to the configuration, it is possible to reduce a probability of adhesion of the moisturizing liquid to the liquid ejecting unit even though the moisturizing liquid is spattered by vibration and the like from an outside of the capping device.

The capping device preferably further includes a capillary member which has a capillary force and is disposed to be extended from an inside of the connection flow channel into the space. In the capping device, preferably, the moisturizing liquid supply unit supplies the moisturizing liquid to the moisturizing liquid storage unit so as to cause the first position to be positioned in a disposition region of the capillary member in the vertical direction.

According to the configuration, it is possible to improve a moisturizing effect of the inside of the space by the capillary member.

In the capping device, preferably, the moisturizing cap and the moisturizing liquid storage unit are provided to be movable in synchronization with each other in the vertical direction.

According to the configuration, for example, in a case where the moisturizing cap that forms a space including the nozzle approaches the liquid ejecting unit, the moisturizing liquid storage unit also similarly moves. Thus, it is possible to hold a positional relationship between the moisturizing cap and the moisturizing liquid storage unit in the vertical direction, and to maintain the position of the liquid surface of the moisturizing liquid to be constant.

In the capping device, preferably, the moisturizing liquid supply unit allows a supply of the moisturizing liquid to the moisturizing liquid storage unit, so as to cause the liquid surface of the moisturizing liquid in the moisturizing liquid storage unit to be a second position which is higher than an opening of the atmospheric communication portion on the space side in the vertical direction.

According to the configuration, for example, even though a liquid dropped from the nozzle adheres to the opening of the atmospheric communication portion on the space side, and the atmospheric communication portion is clogged, the moisturizing liquid is caused to reach the opening of the atmospheric communication portion on the space side, and thus it is possible to remove the adhering liquid by the moisturizing liquid.

In the capping device, preferably, the moisturizing liquid supply unit includes a moisturizing liquid accommodation unit configured to accommodate the moisturizing liquid, a supply flow channel for supplying the moisturizing liquid in the moisturizing liquid accommodation unit to the moisturizing liquid storage unit, and a buoyancy object which is movable in accordance with a change of a position of the liquid surface of the moisturizing liquid in the moisturizing liquid storage unit and includes a valve portion which allows opening and closing of the supply flow channel.

According to the configuration, when the buoyancy object moves in accordance with a change of the position of the liquid surface of the moisturizing liquid stored in the moisturizing liquid storage unit, the valve portion included in the buoyancy object also moves, and thus the supply flow channel is opened or closed. That is, for example, the supply flow channel is closed by the valve portion when the liquid surface of the moisturizing liquid stored in the moisturizing liquid storage unit is lowered. Thus, the moisturizing liquid supply unit can supply the moisturizing liquid so as to hold the liquid surface of the moisturizing liquid stored in the moisturizing liquid storage unit to be constant.

In the capping device, preferably, the moisturizing liquid supply unit include a moisturizing liquid accommodation unit configured to accommodate the moisturizing liquid and a supply flow channel for supplying the moisturizing liquid in the moisturizing liquid accommodation unit to the moisturizing liquid storage unit, and an opening end of the supply flow channel which opens in the moisturizing liquid storage unit is disposed at a position which is the same as the first position in the vertical direction.

According to the configuration, the moisturizing liquid is supplied from the moisturizing liquid accommodation unit to the moisturizing liquid storage unit by a water head difference, and thus the moisturizing liquid is supplied so as to cause the liquid surface of the moisturizing liquid stored in the moisturizing liquid storage unit to be a position which is the same as that of the opening end of the supply flow channel. That is, the moisturizing liquid supply unit can supply the moisturizing liquid so as to hold the liquid surface of the moisturizing liquid stored in the moisturizing liquid storage unit to be constant.

According to another aspect of the invention, there is provided a liquid ejecting apparatus which includes a liquid ejecting unit configured to eject a liquid from a nozzle, a moisturizing cap which is brought into contact with the liquid ejecting unit so as to allow forming of a space including the nozzle, a connection flow channel which is connected to the moisturizing cap, and a moisturizing liquid supply unit which is connected to the connection flow channel, includes a moisturizing liquid storage unit configured to allow storing of a moisturizing liquid, and allows a supply of the moisturizing liquid to the moisturizing liquid storage unit so as to cause a liquid surface of the moisturizing liquid in the moisturizing liquid storage unit to be a first position. The moisturizing cap includes an atmospheric communication portion configured to open the space to an atmosphere.

According to the configuration, the liquid ejecting apparatus shows an effect similar to that of the capping device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of an ink jet printer that prints text, images or the like while ejecting ink that is a liquid will be described as an example of the liquid ejecting apparatus with reference to the drawings.

First Embodiment

Figure 1:
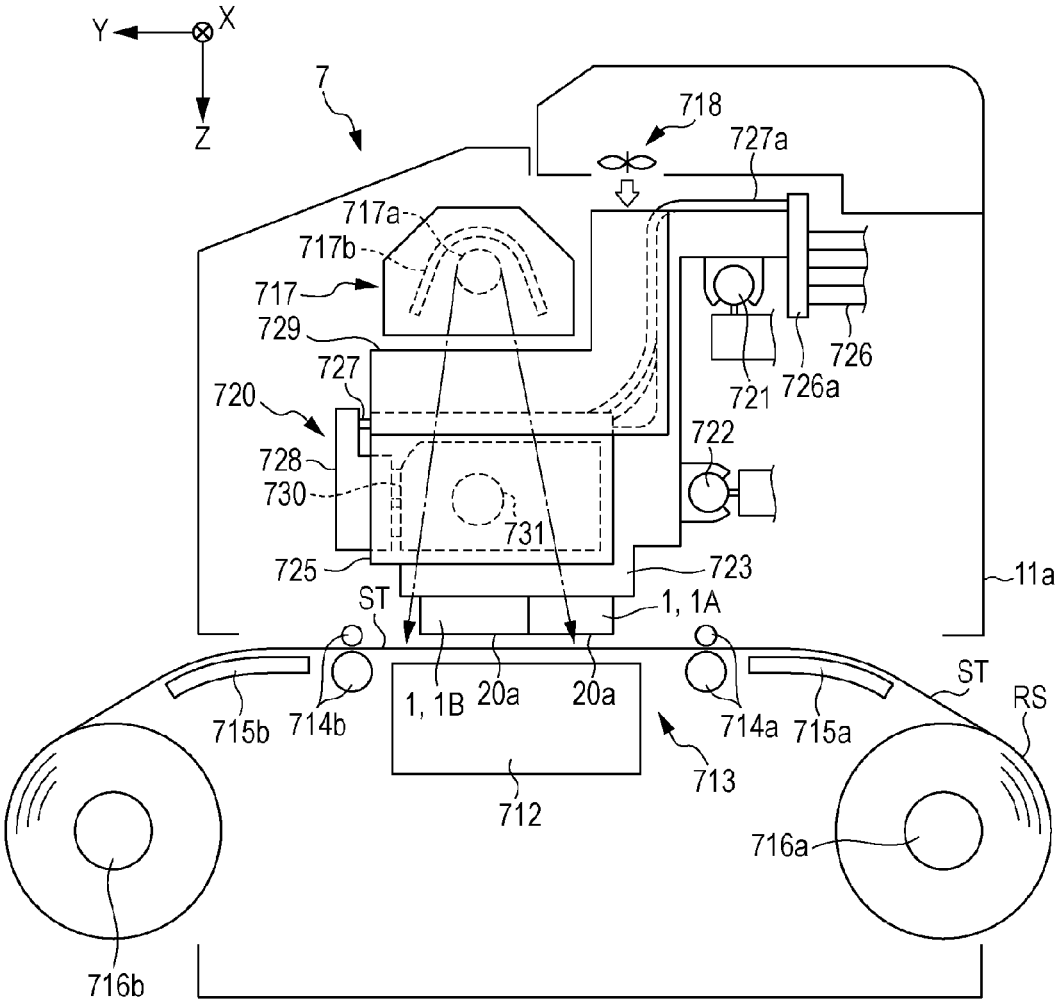
FIG. 1 is a schematic view illustrating a liquid ejecting apparatus which includes a capping device.

As illustrated in FIG. 1, a liquid ejecting apparatus 7 includes a transport unit 713, a printing unit 720, and a heating unit 717 and a blower 718. The transport unit 713 transports a sheet-like medium ST supported on a support stand 712 in a transport direction Y along the surface of the support stand 712. The printing unit 720 performs printing by ejecting an ink as an example of a liquid to the transported medium ST. The heating unit 717 and the blower 718 are provided for drying the ink landed on the medium ST.

The support stand 712, the transport unit 713, the heating unit 717, the blower 718, and the printing unit 720 are assembled in a printer main body 11*a* configured by a housing, a frame and the like. In the printer main body 11*a*, the support stand 712 extends in the width direction (in FIG. 1, direction orthogonal to the paper surface) of the medium ST.

Figure 16:
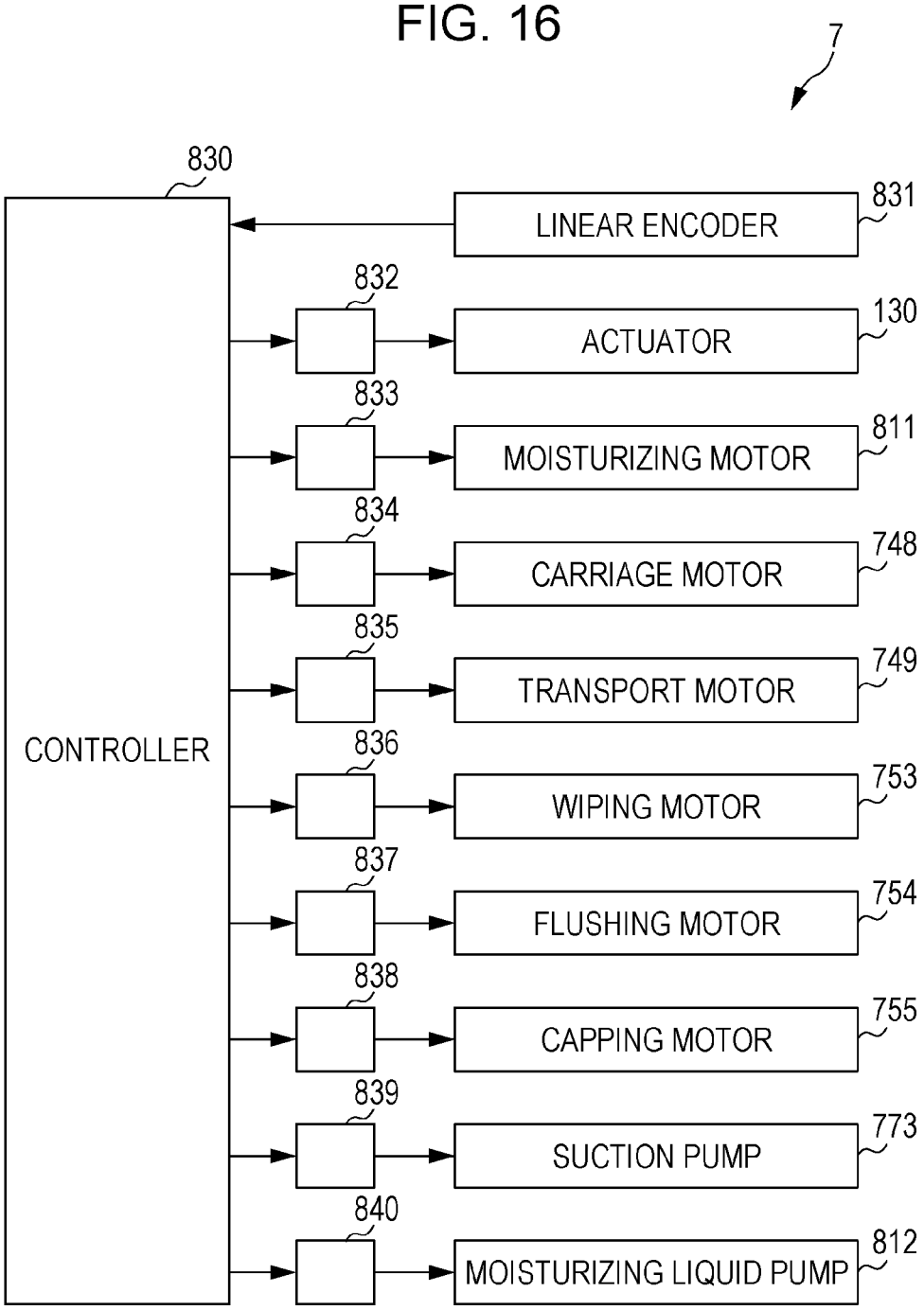
FIG. 16 is a block diagram illustrating an electrical configuration of the liquid ejecting apparatus.

The transport unit 713 includes a transport roller pair 714*a* and a transport roller pair 714*b* which are respectively arranged on the upstream side and the downstream side of the support stand 712 in the transport direction Y, and are driven by a transport motor 749 (refer to FIG. 16). The transport unit 713 further includes a guide plate 715*a* and a guide plate 715*b* which are respectively arranged on the upstream side of the transport roller pair 714*a* and the downstream side of the transport roller pair 714*b* in the transport direction Y. The guide plate 715*a* and the guide plate 715*b* guide the medium ST with supporting the medium ST.

The transport unit 713 transports the medium ST along the surfaces of the guide plate 715*a*, the support stand 712, and the guide plate 715*b* by the transport roller pairs 714*a* and 714*b* rotating while interposing the medium ST. In the embodiment, the medium ST is continuously transported by being delivered from a roll sheet RS rolled in a roll shape on a supply reel 716*a*. The medium ST which is continuously transported while being delivered from the roll sheet RS is wound up in a roll shape by a winding reel 716*b* after an image is printed with ink adhering thereto by the printing unit 720.

The printing unit 720 includes a carriage 723. The carriage 723 is guided on guide shafts 721 and 722 which are extended along a scanning direction X being the width direction of the medium ST, which is orthogonal to the transport direction Y of the medium ST, and is able to reciprocate in the scanning direction X by the power of a carriage motor 748 (refer to FIG. 16). In the embodiment, the scanning direction X is a direction that intersects (as an example, is orthogonal to) both the transport direction Y and a gravity direction Z.

Two liquid ejecting units 1 (1A, 1B) configured to eject an ink, a liquid supply path 727 configured to supply the ink to the liquid ejecting units 1 (1A, 1B), a storage portion 730 configured to temporarily store the ink supplied through the liquid supply path 727, and a flow channel adapter 728 connected to the storage portion 730 are provided on the carriage 723. The storage portion 730 is held to the storage portion holder 725 attached to the carriage 723. In the embodiment, an ejection direction of ink droplets (liquid droplets) from the liquid ejecting unit 1 is the gravity direction Z.

The storage portion 730 includes a differential pressure valve 731 which is provided at a position along the liquid supply path 727 for supplying ink to the liquid ejecting units 1. The differential pressure valve 731 is opened when pressure of the ink on the downstream side reaches predetermined reduced pressure with respect to atmospheric pressure with ejection (consumption) of ink by the liquid ejecting units 1A and 1B positioned on the downstream side thereof. The differential pressure valve 731 is closed when the ink is supplied to the liquid ejecting units 1A and 1B from the storage portion 730 by opening the valve, and thus the reduced pressure on the downstream side is released. The differential pressure valve 731 functions as a unidirectional valve (check valve) that allows a supply of an ink from the upstream side (storage portion 730 side) to the downstream side (liquid ejecting unit 1 side), but suppresses backward flow of the ink from the downstream side to the upstream side without opening even if the pressure of the ink on the downstream side becomes high.

The liquid ejecting unit 1 is attached to a lower end portion of the carriage 723 in a posture of facing the support stand 712 spaced with a predetermined gap in the gravity direction Z. The storage portion 730 is attached to an upper side that is a side opposite to the liquid ejecting unit 1 in the gravity direction Z, with respect to the carriage 723.

An end portion on the upstream side of a supply tube 727*a* that constitutes a portion of the liquid supply path 727 is connected to an end portion on the downstream side of a plurality of ink supply tubes 726 which are able to be deformed with tracking the reciprocating carriage 723. The connection is performed through a connector 726*a* attached to a portion of the carriage 723. An end portion on the downstream side of the supply tube 727*a* is connected to the flow channel adapter 728 at a position further to the upstream side than the storage portion 730. Thus, an ink from an ink tank (not illustrated) in which the ink is accommodated is supplied to the storage portion 730 through the ink supply tube 726, the supply tube 727*a*, and the flow channel adapter 728.

In the printing unit 720, an ink is ejected from openings of a plurality of nozzles 21 (refer to FIG. 3) of the liquid ejecting unit 1 to the medium ST on the support stand 712 in a process where the carriage 723 moves (reciprocates) in the scanning direction X. The heating unit 717 for heating the ink landed on the medium ST so as to dry the ink is arranged at an upper position spaced from the support stand 712 in the liquid ejecting apparatus 7 by a gap with a predetermined length in the gravity direction Z. The printing unit 720 is able to reciprocate between the heating unit 717 and the support stand 712 along the scanning direction X.

The heating unit 717 includes a heating member 717*a* such as an infrared heater and a reflection plate 717*b* which are arranged extending along the scanning direction X that is the same as an extension direction of the support stand 712. The heating unit 717 heats the ink adhering to the medium ST by heat (for example, radiation heat) such as infrared rays radiated to an area indicated by a dashed-line arrow in FIG. 1. The blower 718 configured to dry the ink adhering to the medium ST with an air flow is disposed at an upper position with a gap in which the printing unit 720 in the liquid ejecting apparatus 7 is able to reciprocate between the blower 718 and the support stand 712.

A heat blocking member 729 that blocks heat transferred from the heating unit 717 is provided at a position between the storage portion 730 and the heating unit 717 on the carriage 723. The heat blocking member 729 is formed of a metal material with good thermal conductivity, such as stainless steel or aluminum, and covers at least an upper surface portion of the storage portion 730, which opposes the heating unit 717.

In the liquid ejecting apparatus 7, the storage portion 730 is provided for at least each type of ink. The liquid ejecting apparatus 7 in the embodiment includes a storage portion 730 in which a colored ink is stored, and is capable of color printing and black and white printing. Ink colors of the colored ink are cyan, magenta, yellow, black, and white, as an example. A preservative is included in each colored ink.

A white ink is used for base printing and the like (also referred to as solid printing or fill printing) before color printing is performed, in a case where the medium ST is a transparent or semi-transparent medium or is a dark colored medium. The colored ink to be used may be arbitrarily selected, and may be any of the three colors of cyan, magenta, and yellow. At least one colored ink of light cyan, light magenta, light yellow, orange, green, grey and the like may be also added in addition to the above three colors.

Figure 2:
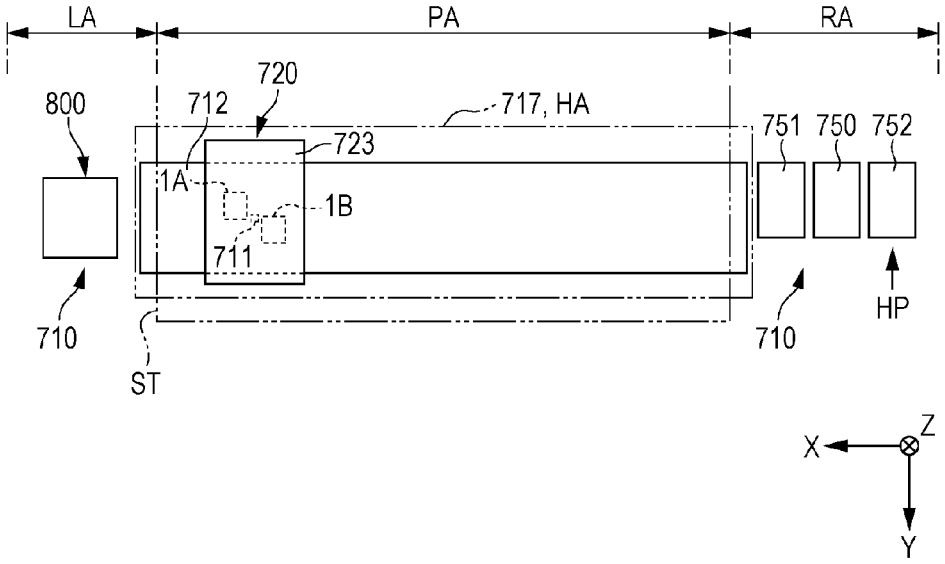
FIG. 2 is a plan view schematically illustrating an arrangement of constituent elements of the liquid ejecting apparatus.

As illustrated in FIG. 2, the two liquid ejecting units 1A and 1B attached to the lower end portion of the carriage 723 are arranged so as to be separated to each other by a predetermined gap in the scanning direction X and shifted from each other by a predetermined distance in the transport direction Y. A temperature sensor 711 is provided at a position between the two liquid ejecting units 1A and 1B in the scanning direction X on the lower end portion of the carriage 723.

A movement region in which the liquid ejecting units 1A and 1B are able to move in the scanning direction X includes a printing area PA and non-printing areas RA and LA. In the printing area PA, inks from nozzles 21 of the liquid ejecting units 1A and 1B are ejected during printing on the medium ST. The non-printing areas RA and LA are regions on the outside of the printing area PA, in which the liquid ejecting units 1A and 1B which are able to move in the scanning direction X do not oppose the medium ST during transport. A region facing the printing area PA in the scanning direction X is set as a heating region HA heated by the heating unit 717 that fixes the ink landed on the medium ST fixed by heating.

A region having the maximum width in the scanning direction X, in which ink droplets ejected from the liquid ejecting units 1A and 1B are landed, with respect to the maximum width of the medium ST transported on the support stand 712 is set as the printing area PA. That is, ink droplets ejected from the liquid ejecting units 1A and 1B to the medium ST land within the printing area PA. In a case where the printing unit 720 has an edgeless printing function, the printing area PA is slightly wider in the scanning direction X than the range of the medium ST which is transported and has the maximum width.

The non-printing areas RA and LA are provided on both sides (left and right sides, respectively, in FIG. 2) of the printing area PA in the scanning direction X. A capping device 800 which includes a moisturizing cap for moisturizing the liquid ejecting unit 1 is provided in the non-printing area LA position on the left side of the printing area PA in FIG. 2. A wiper unit 750, a flushing unit 751, and a cap unit 752 are provided in the non-printing area RA positioned on the right side of the printing area PA in FIG. 2.

The capping device 800, the wiper unit 750, the flushing unit 751, and the cap unit 752 constitute a maintenance device 710 for performing maintenance of the liquid ejecting unit 1. A position at which the cap unit 752 is provided in the scanning direction X is set as a home position HP of the liquid ejecting units 1A and 1B. The home position HP is a standby position when the liquid ejecting unit 1 is stopped in a standby state outside the printing area PA as a liquid ejecting region.

Configuration of Head Unit

Next, a configuration of a head unit 2 will be described in detail.

The liquid ejecting unit 1 includes a plurality (in the embodiment, 4) of head units 2 provided for each color of ink (for each type of the liquid).

Figure 3:
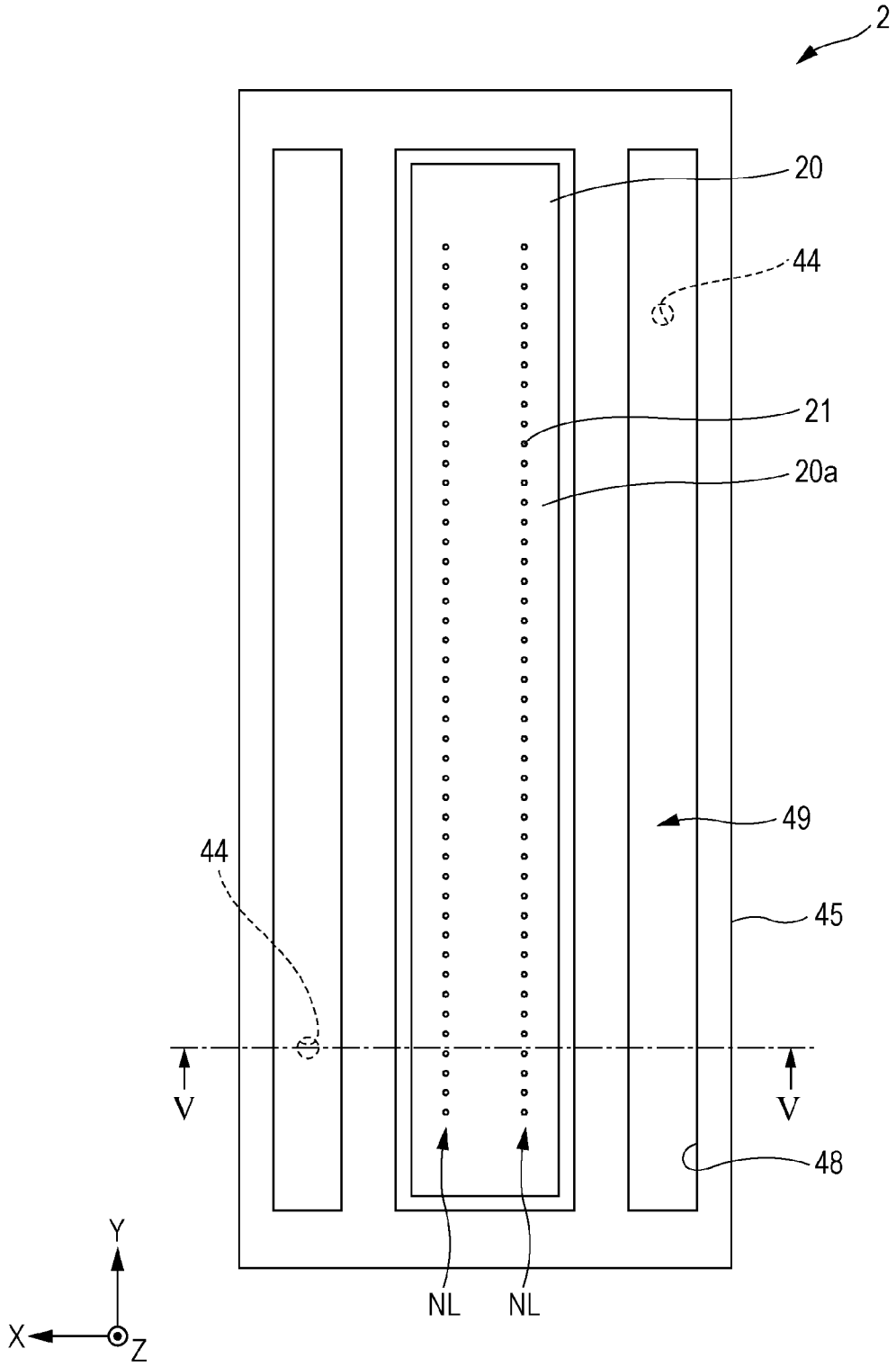
FIG. 3 is a bottom view of a head unit.

As illustrated in FIG. 3, in one head unit 2, a nozzle line NL is configured by lining up openings of multiple (for example, 180) nozzles 21 for ejecting ink in one direction (in the embodiment, transport direction Y) at a fixed nozzle pitch.

In the embodiment, two nozzle lines NL lined up in the scanning direction X are provided in one head unit 2, and thus a total 8 nozzle lines NL in which two lines positioned so as to approach one another are arranged with a fixed gap in the scanning direction X are formed in one liquid ejecting unit 1. The two liquid ejecting units 1 have a positional relationship in the transport direction Y, in which the same nozzle pitch is obtained with each other between the nozzles 21 at the end portions when the multiple nozzles 21 that constitute each of the nozzle rows NL are projected in the scanning direction X.

Figure 4:
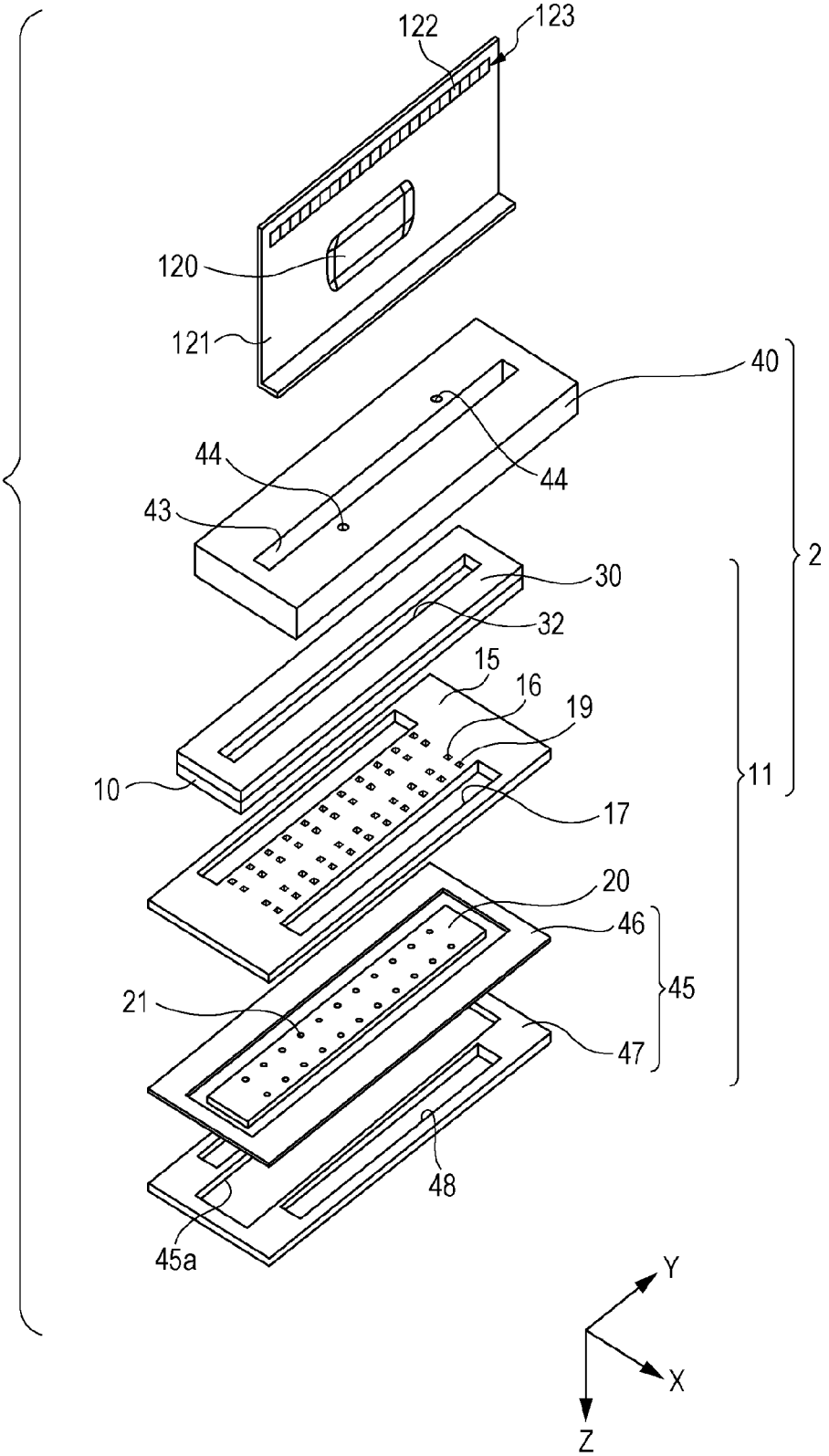
FIG. 4 is an exploded perspective view of the head unit.

As illustrated in FIG. 4, the head unit 2 includes a plurality of members, such as a head main body 11 and a flow channel-forming member 40 fixed to one surface (upper surface) side of the head main body 11. The head main body 11 includes a flow channel-forming substrate 10, a communication plate 15, a nozzle plate 20, a protective substrate 30, and a compliance substrate 45. The communication plate 15 is provided on one surface (lower surface) side of the flow channel-forming substrate 10. The nozzle plate 20 is provided on a surface side of the communication plate 15, which is an opposite surface (lower surface) side to the flow channel-forming substrate 10. The protective substrate 30 is provided on a surface side of the flow channel-forming substrate 10 which is an opposite side (upper side) to the communication plate 15. The compliance substrate 45 is provided on the surface side of the communication plate 15, on which the nozzle plate 20 is provided.

For the flow channel-forming substrate 10, for example, metal such as stainless steel or Ni, a ceramic material represented by $ZrO_2$ or $Al_2O_3$, a glass ceramic material, or an oxide such as MgO or $LaAlO_3$ may be used. In the embodiment, the flow channel-forming substrate 10 is formed by a silicon single crystal substrate.

Figure 5:
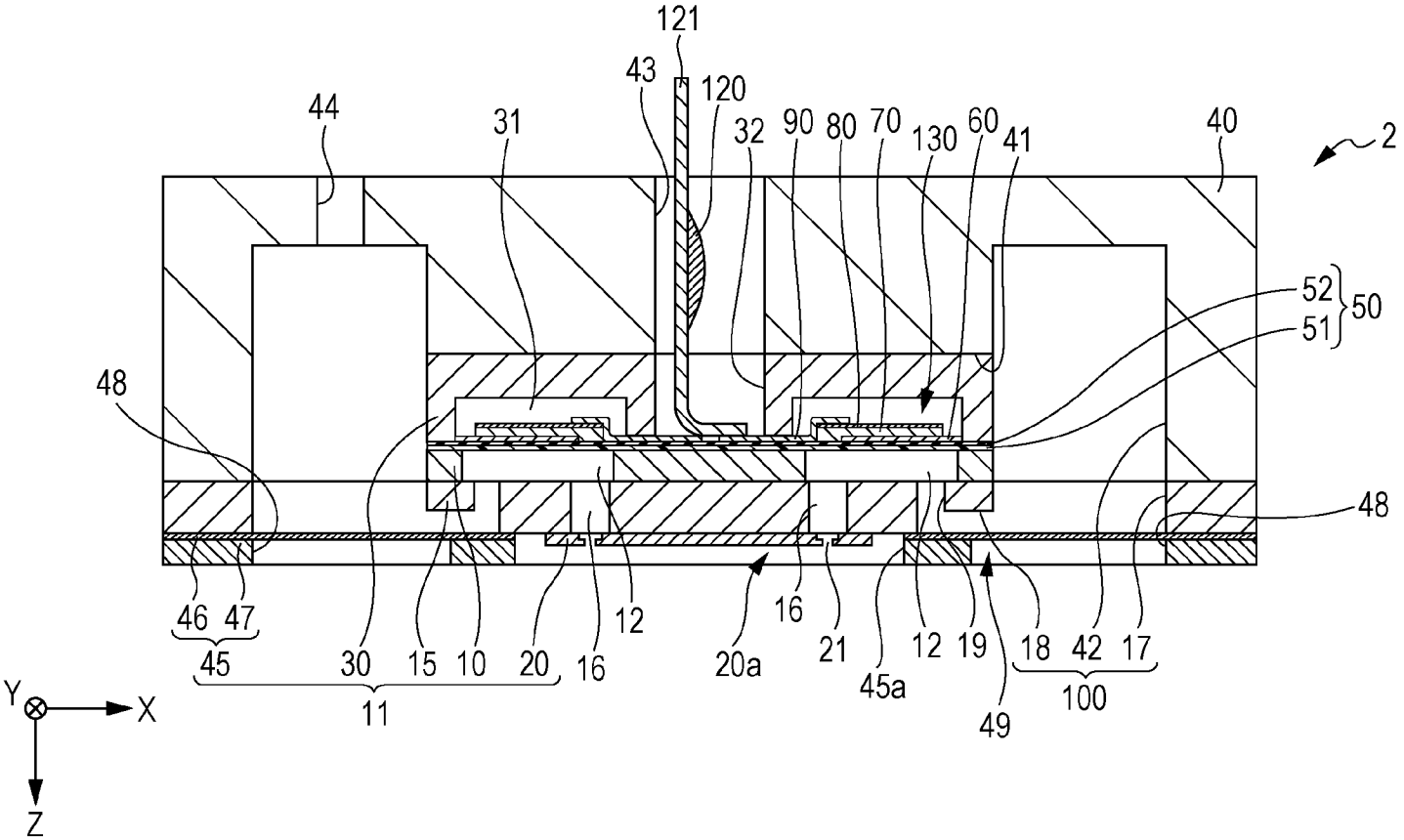
FIG. 5 is a cross-sectional view taken along line V-V in FIG. 3.

As illustrated in the FIG. 5, the flow channel-forming substrate 10 is subjected to anisotropic etching from one surface side thereof, and thus pressure generating chambers 12 partitioned by a plurality of partition walls are provided on the flow channel-forming substrate 10. The pressure generating chambers 12 are provided in parallel along a direction in which the plurality of nozzles 21 which discharge the ink are provided in parallel. A plurality of rows (in the embodiment, 2) in which the pressure generating chambers 12 are arranged in parallel in the transport direction Y are provided on the flow channel-forming substrate 10 so as to be lined up in the scanning direction X.

A supply path or the like may be provided on one end side of the pressure generating chamber 12 in the transport direction Y on the flow channel-forming substrate 10. The supply path or the like has an opening area smaller than that of the pressure generating chamber 12 and applies flow channel resistance of the ink flowing into the pressure generating chamber 12.

As illustrated in FIGS. 4 and 5, the communication plate 15 and the nozzle plate 20 are layered in the gravity direction Z on one surface (lower surface) side of the flow channel-forming substrate 10. That is, the liquid ejecting unit 1 includes the communication plate 15 which is provided on one surface of the flow channel-forming substrate 10, and the nozzle plate 20 in which nozzles 21 provided on a surface side of the communication plate 15, which is opposite to the flow channel-forming substrate 10 are formed.

A nozzle communication path 16 through which the pressure generating chamber 12 and the nozzle 21 communicate with each other is provided on the communication plate 15. The communication plate 15 has an area larger than that of the flow channel-forming substrate 10. The nozzle plate 20 has an area smaller than that of the flow channel-forming substrate 10. As described above, since the communication plate 15 is provided and thus the nozzles 21 of the nozzle plate 20 are separated from the pressure generating chamber 12, it is difficult to thicken an ink in the pressure generating chamber 12 due to evaporation of moisture in the ink from the nozzle 21. Since the nozzle plate 20 may cover only an opening of the nozzle communication path 16 through which the pressure generating chamber 12 and the nozzle 21 communicate with each other, it is possible to cause the area of the nozzle plate 20 to be relatively small and to achieve cost reduction.

As illustrated in FIG. 5, a first manifold portion 17 and a second manifold portion 18 (restricted flow channel, orifice flow channel) which constitute a portion of a common liquid chamber (manifold) 100 are provided in the communication plate 15. The first manifold portion 17 is provided so as to penetrate the communication plate 15 in a thickness direction (gravity direction Z which is a layering direction of the communication plate 15 and the flow channel-forming substrate 10). The second manifold portion 18 is provided so as to be open to the nozzle plate 20 side of the communication plate 15, not to penetrate the communication plate 15 in the thickness direction.

A supply communication path 19 which communicates with one end portion of the pressure generating chamber 12 in the transport direction Y is independently provided on the communication plate 15 for each pressure generating chamber 12. The supply communication path 19 causes the second manifold portion 18 and the pressure generating chamber 12 to communicate with each other.

Metal such as stainless steel or nickel (Ni) or a ceramic such as zirconium (Zr) may be used as such a communication plate 15. It is preferable that the communication plate 15 have a material which has the same linear expansion coefficient as that of the flow channel-forming substrate 10. That is, in a case where a material having a linear expansion coefficient which is greatly different from that of the flow channel-forming substrate 10 is used for the communication plate 15, warping arises in the flow channel-forming substrate 10 and the communication plate 15 by being heated or cooled. In the embodiment, the same material as that of the flow channel-forming substrate 10, that is, a silicon single crystal substrate is used for the communication plate 15, and thus it is possible to suppress an occurrence of warping caused by heat, an occurrence of cracks, peeling, or the like caused by heat.

A surface (lower surface) on which ink droplets are discharged among both surfaces of the nozzle plate 20, that is, a surface on the opposite side of the pressure generating chamber 12 is referred to as a liquid ejecting surface 20*a*. An opening portion of the nozzle 21, which is open to the liquid ejecting surface 20*a* is referred to as a nozzle opening.

For example, metal such as stainless steel (SUS), an organic matter such as a polyimide resin, or a singly crystal silicon substrate may be used for the nozzle plate 20. A silicon single crystal substrate is used as the nozzle plate 20, and thus it is possible to set the linear expansion coefficients of the nozzle plate 20 and the communication plate 15 to be the same as each other, and is possible to suppress the occurrence of warping by being heated or cooled or the occurrence of cracks, peeling, or the like due to heat.

A diaphragm 50 is formed on a surface side of the flow channel-forming substrate 10, which is opposite to the communication plate 15. In the embodiment, an elastic film 51 and an insulating film 52 are provided as the diaphragm 50. The elastic film 51 is provided on the flow channel-forming substrate 10 side and is formed of silicon oxide. The insulating film 52 is provided on the elastic film 51 and is formed of zirconium oxide. A liquid flow channel of the pressure generating chamber 12 or the like is formed by performing anisotropic etching on the flow channel-forming substrate 10 from one surface side (surface side to which the nozzle plate 20 is bonded). The other surface of the liquid flow channel of the pressure generating chamber 12 or the like is defined by the elastic film 51.

An actuator (piezoelectric actuator) 130 is provided on the diaphragm 50 of the flow channel-forming substrate 10. The actuator 130 is a pressure generating unit in the embodiment and includes a first electrode 60, a piezoelectric layer 70, and a second electrode 80. Here, the actuator 130 is referred to a portion including the first electrode 60, the piezoelectric layer 70, and the second electrode 80.

Generally, either of the electrodes in the actuator 130 is set as a common electrode, and the other electrode is configured by being patterned for each pressure generating chamber 12. In the embodiment, the first electrode 60 is continuously provided over a plurality of actuators 130, and thus is used as the common electrode. The second electrode 80 is individually provided for each actuator 130, and thus is used as an individual electrode.

There is no impediment to reverse these for the convenience of the driving circuit or wiring. In the above-described example, although the diaphragm 50 configured by an elastic film 51 and an insulating film 52 is given as an example, it is not limited thereto. For example, either one of the elastic film 51 and the insulating film 52 may be provided as the diaphragm 50, or only the first electrode 60 may act as the diaphragm without providing the elastic film 51 and the insulating film 52 as the diaphragm 50. The actuator 130 itself may be set to substantially serve as the diaphragm.

The piezoelectric layer 70 is formed from a piezoelectric material of an oxide having a polarized structure. For example, the piezoelectric layer 70 may be formed from a perovskite oxide represented by a general formula $ABO_3$, and a lead-based piezoelectric material including lead or a non-lead based piezoelectric material not including lead may be used.

One end portion of a lead electrode 90 is connected to each of the second electrodes 80 which are individual electrodes of the actuator 130. The lead electrode 90 is formed from gold (Au) or the like, is drawn from the vicinity of the end portion on the opposite side of the supply communication path 19, and is extended onto the diaphragm 50.

A wiring substrate 121 is connected to the other end portion of the lead electrode 90. The wiring substrate 121 is an example of a flexible wiring substrate on which a driving circuit 120 for driving the actuator 130 is provided. The wiring substrate 121 is a sheet-like flexible substrate, and, for example, a COF substrate or the like may be used as the wiring substrate 121.

A second terminal row 123 in which a plurality of second terminals (wiring terminals) 122 which are electrically connected to a first terminal 311 of a head substrate 300 (which will be described later) is arranged in parallel is formed on one surface of the wiring substrate 121. In the embodiment, the plurality of second terminals 122 are arranged in parallel along the scanning direction X to form the second terminal row 123. The driving circuit 120 may not be provided on the wiring substrate 121. That is, the wiring substrate 121 is not limited to a COF substrate, and may be FFC, FPC or the like.

The protective substrate 30 having approximately the same size as that of the flow channel-forming substrate 10 is bonded to the surface of the flow channel-forming substrate 10 on the actuator 130 side. The protective substrate 30 includes a holding portion 31 which is a space for protecting the actuator 130.

The holding portion 31 has a concave shape which is open to the flow channel-forming substrate 10, not penetrates the protective substrate 30 in the gravity direction Z which is the thickness direction. The holding portion 31 is provided independently for each row configured by the actuators 130 provided in parallel in the scanning direction X. That is, the holding portion 31 is provided so as to accommodate the row of the actuators 130 provided in parallel in the scanning direction X, and is provided for each row of actuators 130, that is, two holding portions 31 are provided in parallel in the transport direction Y. Such a holding portion 31 may have a space having a size which does not hinder the movement of the actuator 130. The space may or may not be sealed.

The protective substrate 30 has a through-hole 32 that penetrates the protective substrate 30 in the gravity direction Z that is the thickness direction. The through-hole 32 is provided along the scanning direction X which is an arrangement direction of the plurality of actuators 130 between the two holding portions 31 arranged in parallel in the transport direction Y. That is, the through-holes 32 form openings having a long side in the arrangement direction of the plurality of actuators 130. The other end portion of the lead electrode 90 is provided extending so as to be exposed in the through-hole 32. Thus, the lead electrode 90 and the wiring substrate 121 are electrically connected in the through-hole 32.

It is preferable that materials having substantially the same thermal expansion coefficient as that of the flow channel-forming substrate 10, such as glass and ceramic materials be used for such a protective substrate 30. In the embodiment, the protective substrate 30 is formed by using a silicon single crystal substrate of the same material as that of the flow channel-forming substrate 10. A bonding method of the flow channel-forming substrate 10 and the protective substrate 30 is not particularly limited, and, for example, in the embodiment, the flow channel-forming substrate 10 and the protective substrate 30 are bonded to each other by an adhesive (not illustrated).

The head unit 2 having such a configuration includes a flow channel-forming member 40 that defines the common liquid chamber 100 which communicates with the plurality of pressure generating chamber 12, along with the head main body 11. The flow channel-forming member 40 has substantially the same shape as that of the above-described communication plate 15 in plan view. The flow channel-forming member 40 is bonded to the protective substrate 30 and also bonded to the above-described communication plate 15. Specifically, the flow channel-forming member 40 includes a concavity 41. The concavity 41 has a depth which causes the flow channel-forming substrate 10 and the protective substrate 30 to be accommodated, on the protective substrate 30 side. The concavity 41 has an opening area wider than an area of the surface of the protective substrate 30, which is bonded to the flow channel-forming substrate 10. An opening surface of the concavity 41 on the nozzle plate 20 side is sealed by the communication plate 15, in a state in which the flow channel-forming substrate 10 or the like is accommodated in the concavity 41. Thus, a third manifold portion 42 is defined by the flow channel-forming member 40 and the head main body 11 on the outer peripheral portion of the flow channel-forming substrate 10. The common liquid chamber 100 in the embodiment is configured by the first manifold portion 17 and the second manifold portion 18 provided on the communication plate 15, and the third manifold portion 42 defined by the flow channel-forming member 40 and the head main body 11.

That is, the common liquid chamber 100 includes the first manifold portion 17, the second manifold portion 18, and the third manifold portion 42. The common liquid chamber 100 in the embodiment is disposed on either outer side of the two rows of pressure generating chambers 12 in the transport direction Y. Two common liquid chambers 100 provided on both outer sides of the two rows of pressure generating chambers 12 are independently provided so as not to communicate with each other in the head unit 2. That is, one common liquid chamber 100 is provided to communicate for each row (row provided in parallel to the scanning direction X) of the pressure generating chambers 12 in the embodiment. In other words, the common liquid chamber 100 is provided for each nozzle group. The two common liquid chambers 100 may communicate with each other.

In this manner, the flow channel-forming member 40 is a member that forms a flow channel (common liquid chamber 100) for ink supplied to the head main body 11. The flow channel-forming member 40 has an introduction port 44 which communicates with the common liquid chamber 100. That is, the introduction port 44 is an opening portion which functions as an entrance at which ink supplied to the head main body 11 is introduced to the common liquid chamber 100.

A connection port 43 is provided in the flow channel-forming member 40. The connection port 43 communicates with the through-hole 32 of the protective substrate 30, and the wiring substrate 121 is inserted into the resultant of the communication. The other end portion of the wiring substrate 121 is extended to the opposite side of the ejection direction of ink droplets, which is a penetration direction of the through-hole 32 and the connection port 43, that is, the gravity direction Z.

For example, a resin, metal, or the like may be used as the material of such a flow channel-forming member 40. Mass production at a low cost is possible by forming with resin material for the flow channel-forming member 40.

The compliance substrate 45 is provided on the surface of the communication plate 15, in which the first manifold portion 17 and the second manifold portion 18 open. The compliance substrate 45 has approximately the same size as that of the above-described communication plate 15 in plan view. The compliance substrate 45 includes a first exposure opening portion **45*a* which exposes the nozzle plate 20. Openings of the first manifold portion 17 and the second manifold portion 18 on the liquid ejecting surface 20*a* side are sealed in a state where the compliance substrate 45 exposes the nozzle plate 20 through the first exposure opening portion 45*a*. That is, the compliance substrate 45 defines a portion of the common liquid chamber 100**.

In the embodiment, such a compliance substrate 45 includes a sealing film 46 and a fixed substrate 47. The sealing film 46 is formed from a film-like thin film having flexibility (for example, a thin film which has a thickness of 20 μm or less and is formed by a polyphenylene sulfide (PPS)). The fixed substrate 47 is formed by a hard material such as metal, for example, stainless steel (SUS). A region of the fixed substrate 47, which faces the common liquid chamber 100 is completely removed in the thickness direction, so as to form an opening portion 48. Thus, one surface of the common liquid chamber 100 is set as a compliance portion 49 which is a flexible portion sealed only by the sealing film 46 having flexibility. In the embodiment, one compliance portion 49 is provided corresponding to one common liquid chamber 100. That is, in the embodiment, since two common liquid chambers 100 are provided, two compliance portions 49 are provided on both ends in the transport direction Y with the nozzle plate 20 interposed.

In the head unit 2 having such a configuration, when an ink is ejected, the ink is pulled through the introduction port 44 and the internal portion of a flow channel from the common liquid chamber 100 to the nozzle 21 is fill with the ink. Then, a voltage is applied to each of the actuator 130 corresponding to the pressure generating chamber 12 in accordance with a signal from the driving circuit 120, and thus the diaphragm 50 is flexurally deformed along with the actuator 130. Thus, pressure in the pressure generating chamber 12 increases, and ink droplets are ejected from a predetermined nozzle 21.

Configuration of Liquid Ejecting Unit

Next, the liquid ejecting unit 1 including the head unit 2 will be described in detail.

Figure 6:
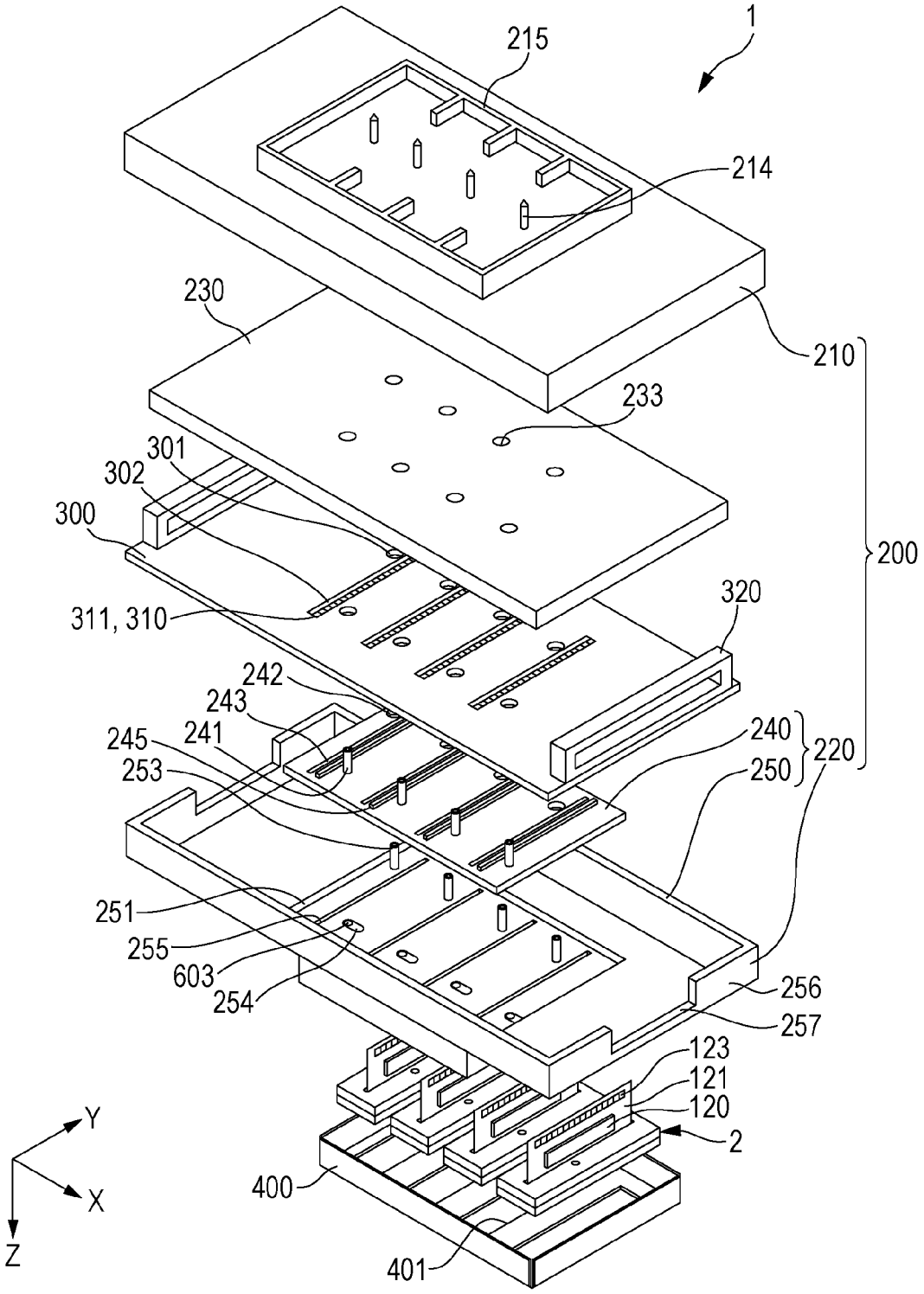
FIG. 6 is an exploded perspective view of a liquid ejecting unit.

As illustrated in FIG. 6, the liquid ejecting unit 1 includes four head units 2, a flow channel member 200, a head substrate 300, a wiring substrate 121. The flow channel member 200 includes a holder member that holds the head units 2 and causes an ink to be supplied to the head unit 2. The head substrate 300 is held to the flow channel member 200. The wiring substrate 121 is an example of a flexible wiring substrate.

Figure 7:
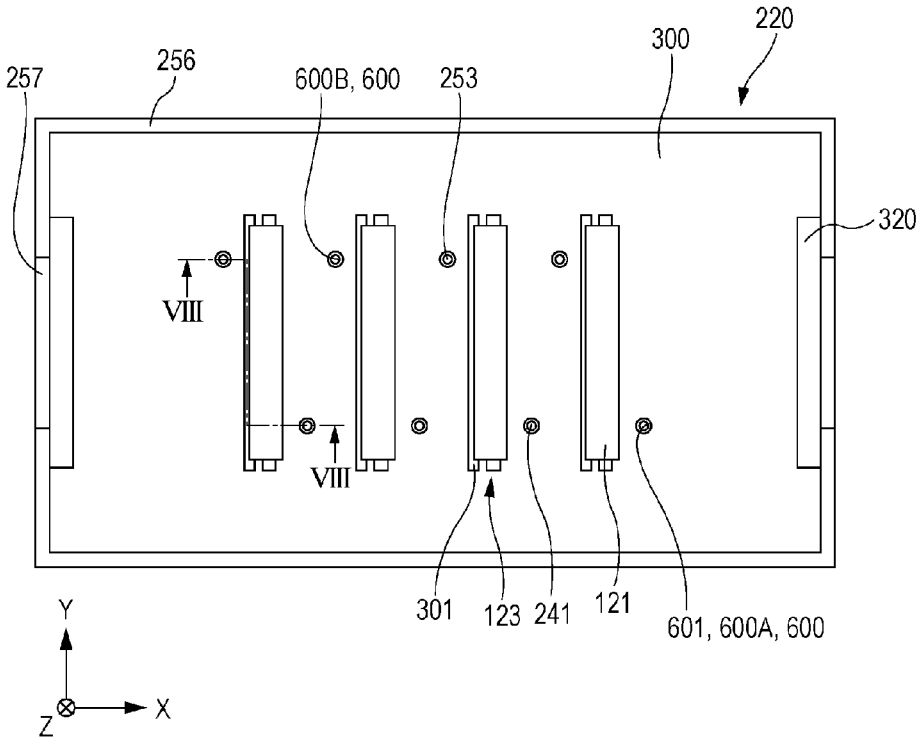
FIG. 7 is a plan view of the liquid ejecting unit.

FIG. 7 illustrates a plan view of the liquid ejecting unit 1 with the depiction of a seal member 230 and an upstream flow channel member 210 omitted.

Figure 8:
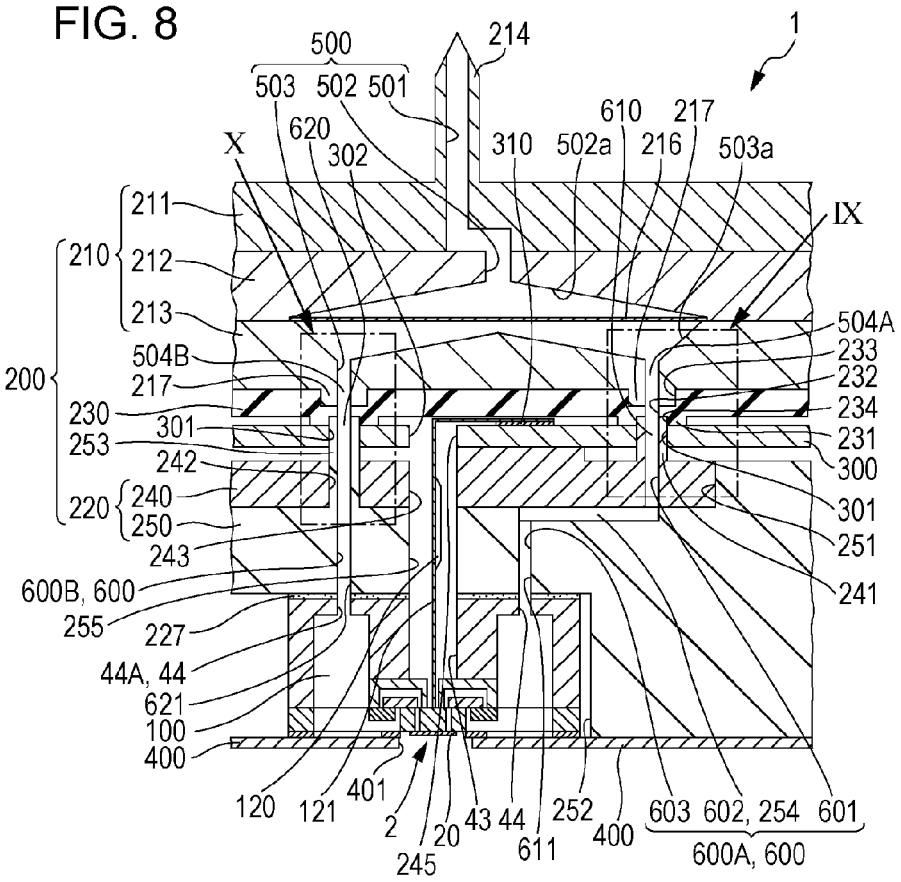
FIG. 8 is a cross-sectional view taken along line VIII-VIII in FIG. 7.

As illustrated in FIG. 8, the flow channel member 200 includes the upstream flow channel member 210, a downstream flow channel member 220 which is an example of the holder member, and the seal member 230 disposed between the upstream flow channel member 210 and the downstream flow channel member 220.

The upstream flow channel member 210 includes an upstream flow channel 500 which functions as a flow channel for ink. In the embodiment, the upstream flow channel member 210 is configured by layering a first upstream flow channel member 211, a second upstream flow channel member 212, and a third upstream flow channel member 213 in the gravity direction Z. A first upstream flow channel 501, a second upstream flow channel 502, and a third upstream flow channel 503 are provided in each of the above members. The upstream flow channel 500 is configured by linking the flow channels 501 to 503 to one another.

The upstream flow channel member 210 is not limited to such a form, and may be configured with a single member or a plurality of two or more members. A layering direction of the plurality of members constituting the upstream flow channel member 210 is also not particularly limited, and may be the scanning direction X or the transport direction Y.

The first upstream flow channel member 211 includes a connector 214 on the opposite surface side to the downstream flow channel member 220. The connector 214 is connected to a liquid holding unit, such as an ink tank or ink cartridge in which ink (liquid) is held. In the embodiment, the connector 214 protrudes in a needle shape. A liquid holding unit such as an ink cartridge may be directly connected to the connector 214 or the liquid holding unit such as an ink tank may be connected through a supply pipe or the like such as a tube.

The first upstream flow channel 501 is provided in the first upstream flow channel member 211. The first upstream flow channel 501 opens to the top surface of the connector 214. The first upstream flow channel 501 is configured by a flow channel extending in the gravity direction Z and a flow channel or the like extending in a plane including a direction orthogonal to the gravity direction Z, that is, the scanning direction X and the transport direction Y, in accordance with the position of the second upstream flow channel 502, which will be described later. A guide wall 215 (see FIG. 6) for positioning the liquid holding unit is provided on the periphery of the connector 214 of the first upstream flow channel member 211.

The second upstream flow channel member 212 is fixed on a surface side of the first upstream flow channel member 211, which is opposite to the connector 214. The second upstream flow channel member 212 includes the second upstream flow channel 502 which communicates with the first upstream flow channel 501. A first liquid reservoir unit 502*a* is provided on the downstream side (third upstream flow channel member 213 side) of the second upstream flow channel 502. The first liquid reservoir unit 502*a* has an inner diameter which is widened more than that of the second upstream flow channel 502.

The third upstream flow channel member 213 is provided on a surface side of the second upstream flow channel member 212, which is opposite to the first upstream flow channel member 211. The third upstream flow channel 503 is provided in the third upstream flow channel member 213. An opening portion of the third upstream flow channel 503 on the second upstream flow channel 502 side functions as a second liquid reservoir unit 503*a* widened in accordance with the first liquid reservoir unit 502*a*. A filter 216 is provided at the opening portion (between the first liquid reservoir unit 502*a* and the second liquid reservoir unit 503*a*) of the second liquid reservoir unit 503*a*. The filter 216 is used for removing air bubbles or foreign materials included in the ink. Thus, the ink supplied from the second upstream flow channel 502 (first liquid reservoir unit 502*a*) is supplied to the third upstream flow channel 503 (second liquid reservoir unit 503*a*) through the filter 216.

For example, a network body such as a metal mesh or a resin net, a porous body, or a metal plate in which fine through-holes are drilled may be used as the filter 216. A metal mesh filter, a filter in which metal fiber, for example, a SUS fine wire is formed in a felt form, or a metal sintered filter in which metal fiber is compressed and sintered, an electroforming metal filter, an electron beam worked metal filter, a laser beam worked metal filter or the like may be used as specific examples of the network body. In particular, a filter in which bubble point pressure (pressure at which the meniscus is formed by the filter perforations is damaged) does not fluctuate is preferable. A filter having a highly-fine hole diameter is appropriate. The filtration grain size of the filter is preferably smaller than the diameter of the nozzle opening, for example, in a case where the nozzle opening is a circular shape, such that foreign materials in the ink are not allowed to reach the nozzle opening.

In a case where a stainless steel mesh filter is employed as the filter 216, twilled Dutch weave (filtration grain size 10 μm) in which the filtration grain size of the filter is smaller than the nozzle opening (for example, in a case where the nozzle opening is a circular shape, the diameter of the nozzle opening is 20 μm) is preferable in order to allow foreign materials in the ink not to reach the nozzle opening. In this case, the bubble point pressure (pressure at which the meniscus formed by the filter perforations is damaged) generated by the ink (surface tension 28 mN/m) is 3 to 5 kPa. In a case where the twilled Dutch weave (filtration grain size 5 μm) is employed, the bubble point pressure (pressure at which the meniscus formed by the filter perforations is damaged) generated by the ink is 0 to 15 kPa.

The third upstream flow channel 503 is branched into two on a downstream side (opposite side to the second upstream flow channel) of the second liquid reservoir unit 503*a*. The third upstream flow channel 503 opens as a first exit port 504A and a second exit port 504B in the surface of the third upstream flow channel member 213 on the downstream flow channel member 220 side. In a case where the first exit port 504A and the second exit port 504B are not distinguished from each other, the ports 504A and 504B are referred to as an exit port 504.

That is, the upstream flow channel 500 corresponding to one connector 214 includes a first upstream flow channel 501, a second upstream flow channel 502, and a third upstream flow channel 503. The upstream flow channel 500 opens as two exit ports 504 (first exit port 504A and second exit port 504B) on the downstream flow channel member 220 side. In other words, the two exit ports 504 (first exit port 504A and second exit port 504B) are provided so as to communicate with the shared flow channel.

A third projection 217 which protrudes toward the downstream flow channel member 220 side is provided on the downstream flow channel member 220 side of the third upstream flow channel member 213. The third projection 217 is provided for each third upstream flow channel 503. The exit port 504 is provided in the tip surface of the third projection 217, in an open state.

The first upstream flow channel member 211, the second upstream flow channel member 212, and the third upstream flow channel member 213 in which such an upstream flow channel 500 is provided are integrally layered by an adhesive or melting or the like. Although the first upstream flow channel member 211, the second upstream flow channel member 212, and the third upstream flow channel member 213 may be fixed by a screw, a clamp or the like, the first upstream flow channel member 211, the second upstream flow channel member 212, and the third upstream flow channel member 213 are preferably bonded to each other by an adhesive, melting or the like, in order to suppress leakage of an ink (liquid) from the connection part from the first upstream flow channel 501 to the third upstream flow channel 503.

In the embodiment, four connectors 214 are provided in one upstream flow channel member 210, and four independent upstream flow channels 500 are provided in one upstream flow channel member 210. An ink corresponding to each of the four head units 2 is supplied to each upstream flow channel 500. The one upstream flow channel 500 is branched into two, and each branch communicates with a downstream flow channel 600 (which will be described later), and is connected to the two introduction ports 44 of the head unit 2.

In the embodiment, although a configuration in which the upstream flow channel 500 is branched into two further to the downstream (downstream flow channel member 220 side) than the filter 216 is described as an example, it is not particularly limited thereto. The upstream flow channel 500 may be branched into three or more further to the downstream side than the filter 216. One upstream flow channel 500 may not be branched further to the downstream than the filter 216.

The downstream flow channel member 220 is an example of the holder member including the downstream flow channel 600 which is bonded to the upstream flow channel member 210 and communicates with the upstream flow channel 500. The downstream flow channel member 220 according to the embodiment is configured by a first downstream flow channel member 240 as an example of a first member, and a second downstream flow channel member 250 as an example of a second member.

The downstream flow channel member 220 includes the downstream flow channel 600 which functions as a flow channel for the ink. The downstream flow channel 600 according to the embodiment is configured by two downstream flow channels 600A and 600B having different shapes.

The first downstream flow channel member 240 is a member formed in a substantially plate shape. The second downstream flow channel member 250 is a member in which a first accommodation portion 251 as a concavity is provided on the surface of the upstream flow channel member 210 side and a second accommodation portion 252 as a concavity is provided on the surface on an opposite side to the upstream flow channel member 210.

The first accommodation portion 251 is formed to have a size enough for accommodating the first downstream flow channel member 240. The second accommodation portion 252 is formed to have a size enough for accommodating four head units 2. The second accommodation portion 252 according to the embodiment may accommodate four head units 2.

A plurality of first projections 241 are formed on a surface of the first downstream flow channel member 240 on the upstream flow channel member 210 side. Each of the first projections 241 is provided so as to face the third projection 217 in which the first exit port 504A is provided, among third projections 217 provided in the upstream flow channel member 210. In the embodiment, four first projections 241 are provided.

A first flow channel 601 is provided in the first downstream flow channel member 240. The first flow channel 601 penetrates the first downstream flow channel member 240 in the gravity direction Z and is opened to the top surface (surface facing the upstream flow channel member 210) of the first projection 241. The third projection 217 and the first projection 241 are bonded to each other through the seal member 230, and thus the first exit port 504A and the first flow channel 601 communicate with each other.

A plurality of second through-holes 242 which penetrate the first downstream flow channel member 240 in the gravity direction Z are formed in the first downstream flow channel member 240. Each of the second through-holes 242 is formed at a position at which a second projection 253 formed in the second downstream flow channel member 250 is inserted. In the embodiment, four second through-holes 242 are provided.

A plurality of first insertion holes 243 in which the wiring substrate 121 electrically connected to the head unit 2 is inserted is formed on the first downstream flow channel member 240. Specifically, each of the first insertion holes 243 is formed so as to perform penetration in the gravity direction Z and to communicate with the second insertion hole 255 of the second downstream flow channel member 250 and the third insertion hole 302 of the head substrate 300. In the embodiment, four first insertion holes 243 are provided corresponding to each wiring substrate 121 provided in four head units 2. A support portion 245 which protrudes to the head substrate 300 side and has a receiving surface is provided in the first downstream flow channel member 240.

A plurality of second projections 253 is formed on the bottom surface of the first accommodation portion 251 in the second downstream flow channel member 250. Each of the second projections 253 is provided so as to face the third projection 217 in which the second exit port 504B is provided among third projections 217 provided in the upstream flow channel member 210. In the embodiment, four second projections 253 are provided. A downstream flow channel 600B is provided in the second downstream flow channel member 250. The downstream flow channel 600B penetrates the second downstream flow channel member 250 in the gravity direction Z and opens to the top surface of the second projection 253 and the bottom surface (surface facing the head unit 2) of the second accommodation portion 252. The third projection 217 and the second projection 253 are bonded to each other through the seal member 230, and thus the second exit port 504B and the downstream flow channel 600B communicate with each other.

A plurality of third flow channels 603 which penetrate the second downstream flow channel member 250 in the gravity direction Z are formed in the second downstream flow channel member 250. Each of the third flow channels 603 opens to the bottom surface of the first accommodation portion 251 and the second accommodation portion 252. In the embodiment, four third flow channels 603 are provided.

A plurality of groove portions 254 which are contiguous with the third flow channels 603 is formed on the bottom surface of the first accommodation portion 251 in the second downstream flow channel member 250. The groove portion 254 forms the second flow channel 602 by being sealed to the first downstream flow channel member 240 accommodated in the first accommodation portion 251. That is, the second flow channel 602 is a flow channel defined by the groove portion 254 and the surface of the first downstream flow channel member 240 on the second downstream flow channel member 250 side. The second flow channel 602 corresponds to a flow channel provided between the first member and the second member described in the claims.

A plurality of second insertion holes 255 in which the wiring substrate 121 electrically connected to the head unit 2 is inserted is formed in the second downstream flow channel member 250. Specifically, each of the second insertion holes 255 is formed so as to penetrate the second downstream flow channel member 250 in the gravity direction Z and to communicate with the first insertion hole 243 of the first downstream flow channel member 240 and the connection port 43 of the head unit 2. In the embodiment, four second insertion holes 255 are provided corresponding to each wiring substrate 121 provided in the four head units 2.

The downstream flow channel 600A is formed by the first flow channel 601, the second flow channel 602, and the third flow channel 603 (which are described above) communicating with each other. Here, the second flow channel 602 is formed in a manner that a groove formed in one surface of the first downstream flow channel member 240 is sealed by the second downstream flow channel member 250. In this manner, the first downstream flow channel member 240 and the second downstream flow channel member 250 are bonded to each other, and thus it is possible to easily form the second flow channel 602 in the downstream flow channel member 220.

The second flow channel 602 is an example of a flow channel extended in the horizontal direction. The second flow channel 602 extending in the horizontal direction means that a component (vector) in the scanning direction X or the transport direction Y is included in an extension direction of the second flow channel 602. The second flow channel 602 extends in the horizontal direction, and thus it is possible to cause the height of the liquid ejecting unit 1 to be reduced in the gravity direction Z. If the second flow channel 602 is inclined to the horizontal direction, a slight height is necessary for the liquid ejecting unit 1.

The extension direction of the second flow channel 602 is a direction in which an ink (liquid) in the second flow channel 602 flows. Accordingly, the second flow channel 602 includes a case of being provided in the horizontal direction (direction orthogonal to the gravity direction Z), and a case of being provided so as to intersect in the gravity direction Z and the horizontal direction (in-plan direction of the scanning direction X and the transport direction Y). In the embodiment, the first flow channel 601 and the third flow channel 603 are provided along the gravity direction Z, and the second flow channel 602 is provided along the horizontal direction (transport direction Y). The first flow channel 601 and the third flow channel 603 may be provided in a direction intersecting with gravity direction Z.

The downstream flow channel 600A is not limited thereto, and a flow channel other than the first flow channel 601, the second flow channel 602, and the third flow channel 603 may be provided. The downstream flow channel 600A may not be configured by the first flow channel 601, the second flow channel 602, and the third flow channel 603, and may be configured from one flow channel.

As described above, the downstream flow channel 600B is formed as a through-hole which penetrates the second downstream flow channel member 250 in the gravity direction Z. The downstream flow channel 600B is not limited to such a form. For example, the downstream flow channel 600B may be formed along a direction intersecting the gravity direction Z, or may be configured by causing a plurality of flow channels to communicate with each other, as in the downstream flow channel 600A.

Such a downstream flow channel 600A and a downstream flow channel 600B are configured one by one for one head unit 2. That is, the total 4 groups of the downstream flow channels 600A and 600B are provided in the downstream flow channel member 220.

Among openings on both ends of the downstream flow channel 600A, an opening of the first flow channel 601 with which the first exit port 504A communicates is set as a first inflow port 610. An opening of the third flow channel 603 which opens to the second accommodation portion 252 is set as a first outflow port 611.

Among openings on both ends of the downstream flow channel 600B, an opening of the downstream flow channel 600B with which the second exit port 504B communicates is set as a second inflow port 620. An opening of the downstream flow channel 600B which opens to the second accommodation portion 252 is set as a second outflow port 621. Hereafter, in a case where the downstream flow channels 600A and 600B are not distinguished from each other, the downstream flow channels 600A and 600B are referred to as the downstream flow channel 600.

As illustrated in FIG. 6, the downstream flow channel member (holder member) 220 holds the head unit 2 on the downward side. Specifically, a plurality (in the embodiment, 4) of the head units 2 are accommodated in the second accommodation portion 252 of the downstream flow channel member 220.

As illustrated in FIG. 8, two introduction ports 44 are provided in each head unit 2. The first outflow port 611 and the second outflow port 621 of the downstream flow channel 600 (downstream flow channels 600A and 600B) are provided in the downstream flow channel member 220 so as to match with the position at which each introduction port 44 opens.

Each of the introduction ports 44 in the head unit 2 is positioned so as to communicate with the first outflow port 611 and the second outflow port 621 of the downstream flow channel 600, which are opened to the bottom surface portion of the second accommodation portion 252. The head unit 2 is fixed to the second accommodation portion 252 by an adhesive 227 provided around each introduction port 44. In this manner, the head unit 2 is fixed to the second accommodation portion 252, and thus the first outflow port 611 and the second outflow port 621 of the downstream flow channel 600 communicate with the introduction port 44, and an ink is supplied to the head unit 2.

The head substrate 300 is mounted on an upward side of the downstream flow channel member (holder member) 220. Specifically, the head substrate 300 is mounted on the surface of the downstream flow channel member 220 on the upstream flow channel member 210 side. The head substrate 300 is a member to which the wiring substrate 121 is connected, and on which electronic components such as circuits configured to control an ejection operation or the like of the liquid ejecting unit 1 or a resistor through the wiring substrate 121 are mounted.

As illustrated in FIG. 6, a first terminal row 310 is formed on the surface on the upstream flow channel member 210 side of the head substrate 300. In the first terminal row 310, a plurality of first terminals (electrode terminals) 311 which are electronically connected to the second terminal rows 123 of the wiring substrate 121 are arranged in parallel. A plurality of first terminals 311 is arranged in parallel along the scanning direction X to form the first terminal row 310 in the embodiment. In the embodiment, the first terminal row 310 is an example of a mounting region electrically connected to the wiring substrate 121.

A plurality of third insertion holes 302 in which the wiring substrate 121 electrically connected to the head unit 2 is inserted is formed in the head substrate 300. Specifically, each of the third insertion holes 302 is formed so as to penetrate the head substrate 300 in the gravity direction Z and to communicate with the first insertion hole 243 of the first downstream flow channel member 240. In the embodiment, four third insertion holes 302 are provided corresponding to each of wiring substrates 121 provided in the four head units 2.

The third through-hole 301 which penetrates the head substrate 300 in the gravity direction Z is provided in the head substrate 300. The first projection 241 of the first downstream flow channel member 240 and the second projection 253 of the second downstream flow channel member 250 are inserted into third through-holes 301. In the embodiment, the total of 8 third through-holes 301 are provided so as to face the first projection 241 and the second projection 253.

The shape of the third through-hole 301 formed in the head substrate 300 is not limited to the above-described form. For example, a common through-hole into which the first projection 241 and the second projection 253 are inserted may be set as an insertion hole. That is, an insertion hole, a notch or the like may be formed in the head substrate 300, so as not to be an impediment when the downstream flow channel 600 of the downstream flow channel member 220 and the upstream flow channel 500 of the upstream flow channel member 210 are connected to each other.

Figure 9:
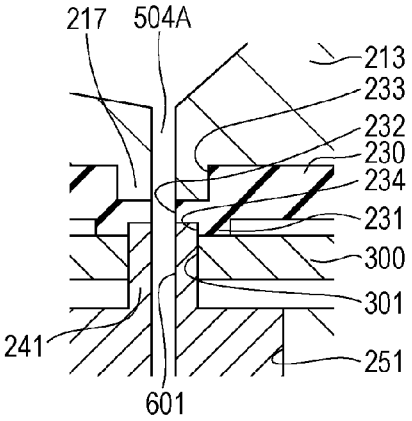
FIG. 9 is an expanded view of the inside of a dashed line frame on the right side in FIG. 8.
Figure 10:
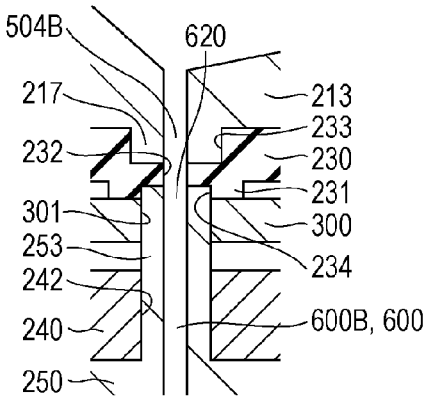
FIG. 10 is an expanded view of the inside of the dashed line frame on the left side in FIG. 8.

As illustrated in FIGS. 8 to 10, the seal member 230 is provided between the head substrate 300 and the upstream flow channel member 210. As a material of the seal member 230, a material (elastic material) which has liquid resistance to liquids such as ink used in the liquid ejecting unit 1 and is elastically deformable, for example, a rubber, elastomer or the like may be used.

The seal member 230 is a plate-like member in which a communication channel 232 passing through in the gravity direction Z and a fourth projection 231 protruding to the downstream flow channel member 220 side are formed. In the embodiment, 8 communication channels 232 and 8 fourth projections 231 are formed corresponding to each upstream flow channel 500 and each downstream flow channel 600.

An annular first concavity 233 in which the third projection 217 is inserted is provided on the upstream flow channel member 210 side of the seal member 230. The first concavity 233 is provided so as to face the fourth projection 231.

The fourth projection 231 protrudes to the downstream flow channel member 220 side, and is provided at a position which faces the first projection 241 and the second projection 253 in the downstream flow channel member 220. A second concavity 234 in which the first projection 241 and the second projection 253 are inserted is provided on the top surface (surface facing the downstream flow channel member 220) of the fourth projection 231.

The communication channel 232 penetrates the seal member 230 in the gravity direction Z. One end of the communication channel 232 opens to the first concavity 233, and the other end thereof opens to the second concavity 234. The fourth projection 231 is held in a state where predetermined pressure is applied in the gravity direction Z. The fourth projection 231 is held between the tip surface of the third projection 217 inserted into the first concavity 233 and the tip surface of the first projection 241 and the second projection 253 inserted in the second concavity 234. Accordingly, the upstream flow channel 500 and the downstream flow channel 600 are caused to communicate with each other in a state of being sealed through the communication channel 232.

A cover head 400 is attached to the second accommodation portion 252 side (lower side) of the downstream flow channel member 220. The cover head 400 is a member to which the head unit 2 is fixed, and which is fixed to the downstream flow channel member 220. A second exposure opening portion 401 which exposes the nozzle 21 is provided in the cover head 400. In the embodiment, the second exposure opening portion 401 has an opening having a size which causes the nozzle plate 20 to be exposed, that is, which is substantially the same at that of the first exposure opening 45*a* portion of the compliance substrate 45.

The cover head 400 is bonded to a surface side of the compliance substrate 45, which is opposite to the communication plate 15. The cover head 400 seals a space of the compliance portion 49 on an opposite side of a flow channel (common liquid chamber 100). In this manner, the compliance portion 49 is covered by the cover head 400, and thus it is possible to suppress damage even if the compliance portion 49 comes into contact with the medium ST. It is possible to suppress adhesion of an ink (liquid) to the compliance portion 49, and to wipe the ink (liquid) adhering to the surface of the cover head 400 with the wiper blade or the like, and it is possible to suppress staining of the medium ST with ink or the like adhering to the cover head 400. Although not particularly illustrated in the drawings, a space between the cover head 400 and the compliance portion 49 is opened to the atmosphere. The cover head 400 may be independently provided for each head unit 2.

Configuration of Maintenance Device

Next, the configuration of the maintenance device 710 will be described in detail.

Figure 11:
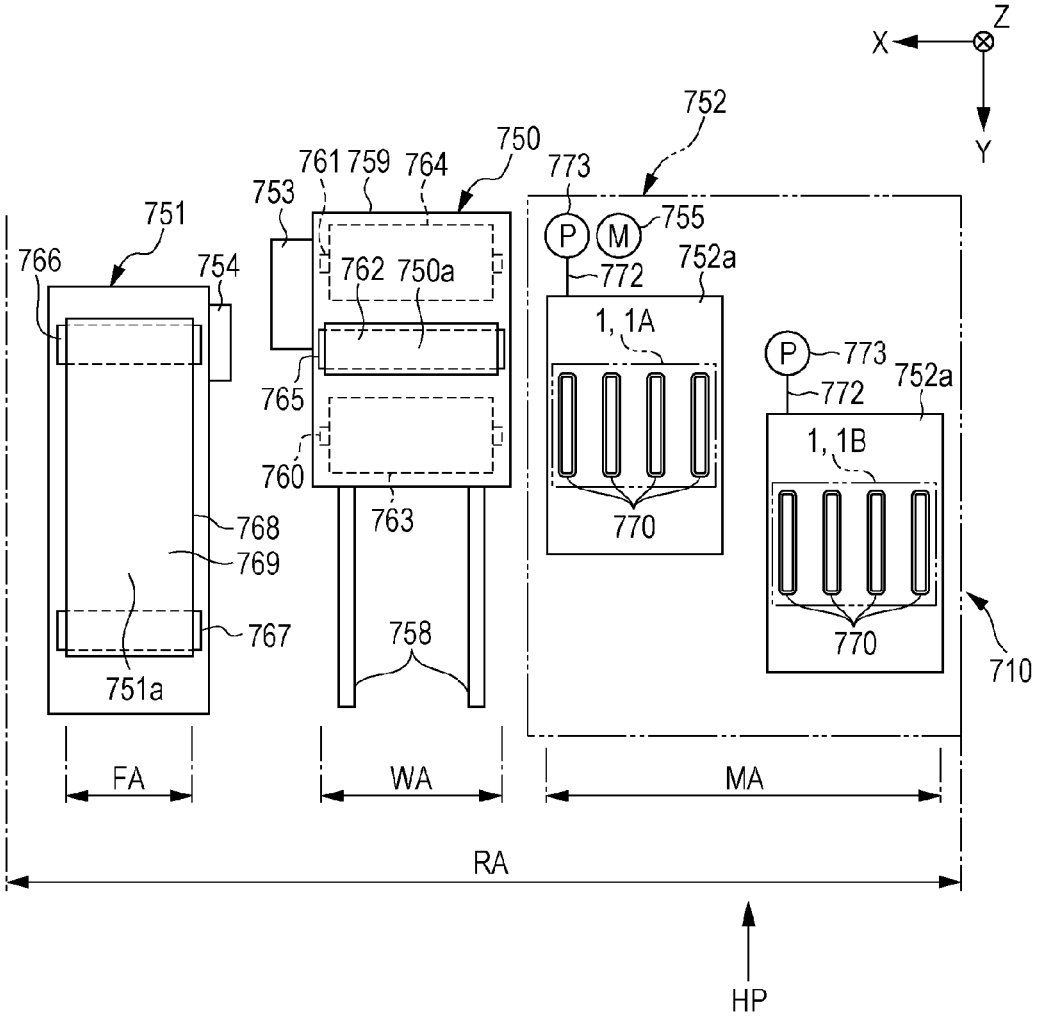
FIG. 11 is a plan view illustrating a configuration of a maintenance device.

As illustrated in FIG. 11, the non-printing area RA includes a receiving area FA, a wiping area WA, and a maintenance area MA. In the receiving area FA, the flushing unit 751 is provided. In the wiping area WA, the wiper unit 750 is provided. In the maintenance area MA, the cap unit 752 is provided. That is, in the non-printing area RA, the receiving area FA, the wiping area WA, and the maintenance area MA are arranged from the printing area PA (see in FIG. 2) side in the scanning direction X, in an order of the receiving area FA, the wiping area WA, the maintenance area MA.

The wiper unit 750 includes a wiping member 750*a* that wipes the liquid ejecting unit 1. The wiping member 750*a* in the embodiment is a movable type, and performs a wiping operation with the power of a wiping motor 753. The flushing unit 751 includes a liquid receiving portion 751*a* that receives ink droplets ejected by the liquid ejecting unit 1.

The liquid receiving portion 751*a* in the embodiment is configured by a belt, and the belt is moved by the power of a flushing motor 754 for a predetermined time period when an amount of ink staining exceeds a prescribed amount by flushing of the belt. Flushing refers to an operation in which ink droplets unrelated to printing are forcefully ejected (discharged) from all nozzles 21 for the purpose of preventing or resolving clogging or the like of the nozzles 21.

The cap unit 752 includes two cap portions 752*a* which are able to come into contact with the liquid ejecting units 1A and 1B so as to surround the openings of the nozzles 21, when the liquid ejecting units 1A and 1B are positioned at the home position HP as indicated by a double dotted line in FIG. 11. The two cap portions 752*a* are configured to be movable between a contact position being in contact with the liquid ejecting unit 1 at the home position HP, and a retreated position separated from the liquid ejecting unit 1. The movement of the two cap portions 752*a* is performed by the power of a capping motor 755.

The wiper unit 750 includes a movable housing 759 which is able to reciprocate on the pair of rails 758 which extend along the transport direction Y. The movable housing 759 performs reciprocation with the power of the wiping motor 753. A delivery shaft 760 and a winding shaft 761 are positioned spaced at predetermined distance in the housing 759. Each of the delivery shaft 760 and the winding shaft 761 are supported so as to be able to rotate in a wiping direction (same direction as the transport direction Y). The delivery shaft 760 supports a delivery roll 763 formed by an unused cloth sheet 762. The winding shaft 761 supports a winding roll 764 formed by the used cloth sheet 762.

The cloth sheet 762 positioned between the delivery roll 763 and the winding roll 764 is wound on the upper surface of a pressing roller 765 which is in a state of being partially protruded upward from an opening (not illustrated) at the central portion of the upper surface of the housing 759. A part thereof wound on the pressing roller 765 forms a semi-cylindrical (convex) wiping member 750*a*. The wiping member 750*a* is in a state of being biased upwardly.

The housing 759 is configured by a cassette and a holder. The cassette accommodates the delivery roll 763 and the winding roll 764. The holder is able to reciprocate in the wiping direction (in the embodiment, direction along the transport direction Y) through a power transmission mechanism (for example, a rack and pinion mechanism) (not illustrated), with the power of the wiping motor 753 guided on the rails 758. The wiping motor 753 is driven forward and reverse, and thus the housing 759 reciprocates once in the transport direction Y between the retreated position illustrated in FIG. 11 and a wiping position at which the wiping member 750*a* finishes wiping on the liquid ejecting unit 1.

At this time, if the reciprocation operation of the housing 759 is finished, the power transmission mechanism performs switching to be in a state where the wiping motor 753 and the winding shaft 761 are connected to each other so as to be able to transmit power. Then, a return operation of the housing 759 and the winding operation of the cloth sheet 762 to the winding roll 764 for a predetermined amount are performed by power when the wiping motor 753 is reverse driven. The two liquid ejecting units 1A and 1B are sequentially moved to the wiping region WA. Wiping on the two liquid ejecting units 1A and 1B by one reciprocation of the housing 759 is separately performed one by one moved to the wiping region WA.

The flushing unit 751 includes a driving roller 766, a driven roller 767, and an endless belt 768. The driving roller 766 and the driven roller 767 are parallel to one another opposed in the transport direction Y. The endless belt 768 is wound between the driving roller 766 and the driven roller 767. The belt 768 has a width of 8 nozzle lines NL (2 rows×4 rows) or more in the scanning direction X, and constitutes a liquid receiving portion 751*a* that receives an ink ejected from each of the nozzles 21 of the liquid ejecting unit 1A and 1B. In this case, the outer peripheral surface of the belt 768 functions as a liquid receiving surface 769 on which an ink is received.

The flushing unit 751 includes a moisturizing liquid supply unit (not illustrated) and a liquid scraping unit (not illustrated). The moisturizing liquid supply unit is able to supply a moisturizing liquid to the liquid receiving surface 769 on the lower side of the belt 768. The liquid scraping unit scrapes off a waste ink or the like adhering to the liquid receiving surface 769 in a moist state. The waste ink received by the liquid receiving surface 769 is removed from the belt 768 by the liquid scraping unit. Thus, a receiving range facing the nozzles 21 on the liquid receiving surface 769 is renewed by the peripheral movement of the belt 768.

The cap unit 752 includes two cap portions 752*a*. The two cap portions 752*a* are able to form a closed space which surrounds the liquid ejecting surface 20*a* (see FIG. 3) which is an opening region in which the nozzles 21 open in contact with the two liquid ejecting units 1A and 1B. Each of the cap portions 752*a* moves between a contact position able to come into contact with the liquid ejecting unit 1, and a retreated position separated from the liquid ejecting unit 1, by power of the capping motor 755. Each of the cap portions 752*a* includes four suction caps 770. Each of the suction caps 770 performs maintenance of the nozzle 21 in a manner of performs capping of being brought into contact with the liquid ejecting unit 1 so as to form a closed space which surrounds two nozzle rows NL (refer to FIG. 3).

The suction cap 770 is connected to a suction pump 773 through a tube 772. The suction pump 773 is driven in a state where the suction cap 770 is brought into contact with the liquid ejecting unit 1 so as to form a sealed space, and thus so-called suction cleaning in which a thickened ink, air bubbles, or the like are suctioned from the nozzles 21 along with an ink and are discharged by an action of negative pressure arising in the suction cap 770 is performed.

If suction cleaning is performed, ink droplets discharged from the nozzle 21 adhere to the liquid ejecting unit 1. Thus, after the suction cleaning is performed, the wiping member 750*a* preferably performs wiping in order to remove the adhering droplets or the like. There is a concern that foreign materials or air bubbles adhering to the liquid ejecting unit 1 are pushed into the nozzles 21 and thus the meniscus is damaged or discharge defects occur, if the wiping member 750*a* performs wiping. Thus, it is preferable that foreign materials mixed into the nozzle 21 be discharged and the meniscus of an ink in the nozzle 21 be set by performing flushing after execution of the wiping.

Figure 12:
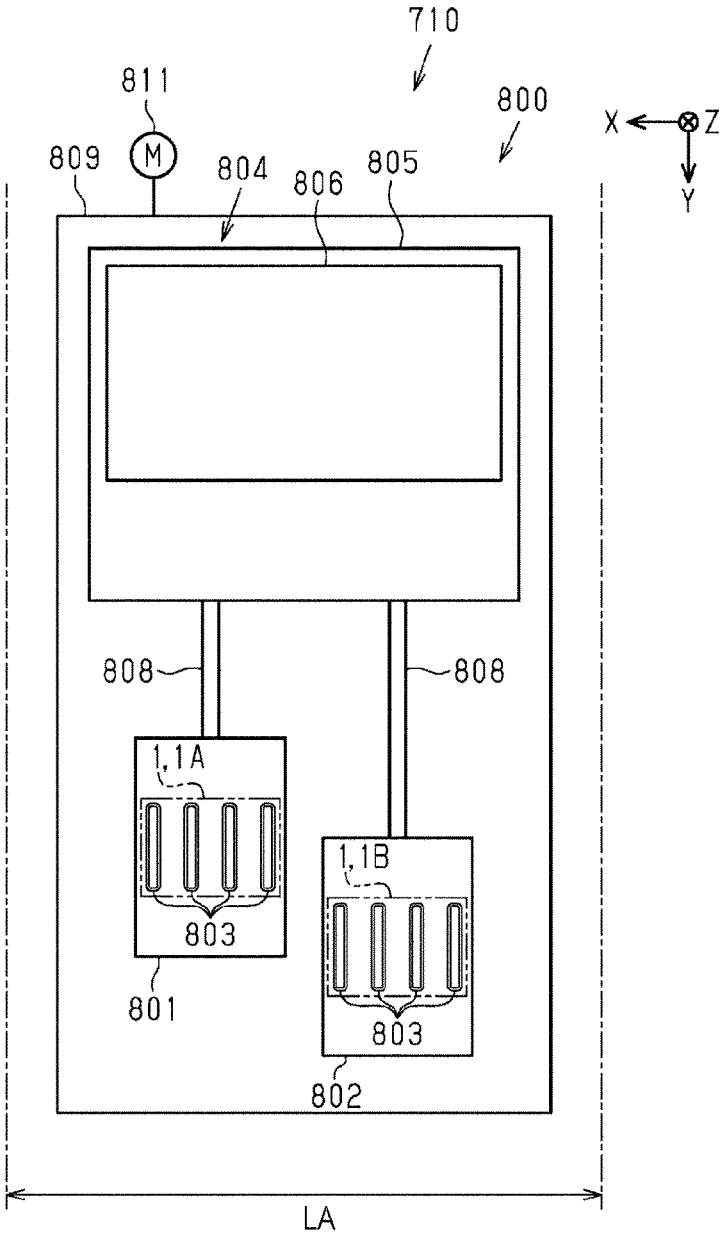
FIG. 12 is a plan view schematically illustrating a configuration of a capping device according to a first embodiment.

As illustrated in FIG. 12, the capping device 800 is disposed in the non-printing area LA positioned on an opposite side of the non-printing area RA in the scanning direction X. The capping device 800 includes moisturizing cap units 801 and 802 that are able to come into contact with each of the liquid ejecting units 1A and 1B so as to surround the openings of the nozzles 21, when the liquid ejecting units 1A and 1B are positioned in the non-printing area LA. Each of the moisturizing cap units 801 and 802 includes four moisturizing caps 803. The moisturizing caps 803 are arranged in parallel to each other in the scanning direction X. The moisturizing caps 803 allows the nozzles 21 to be moist in a manner of performing capping of being brought into contact with the liquid ejecting units 1A and 1B so as to form a space including each two nozzle lines NL.

Figure 13:
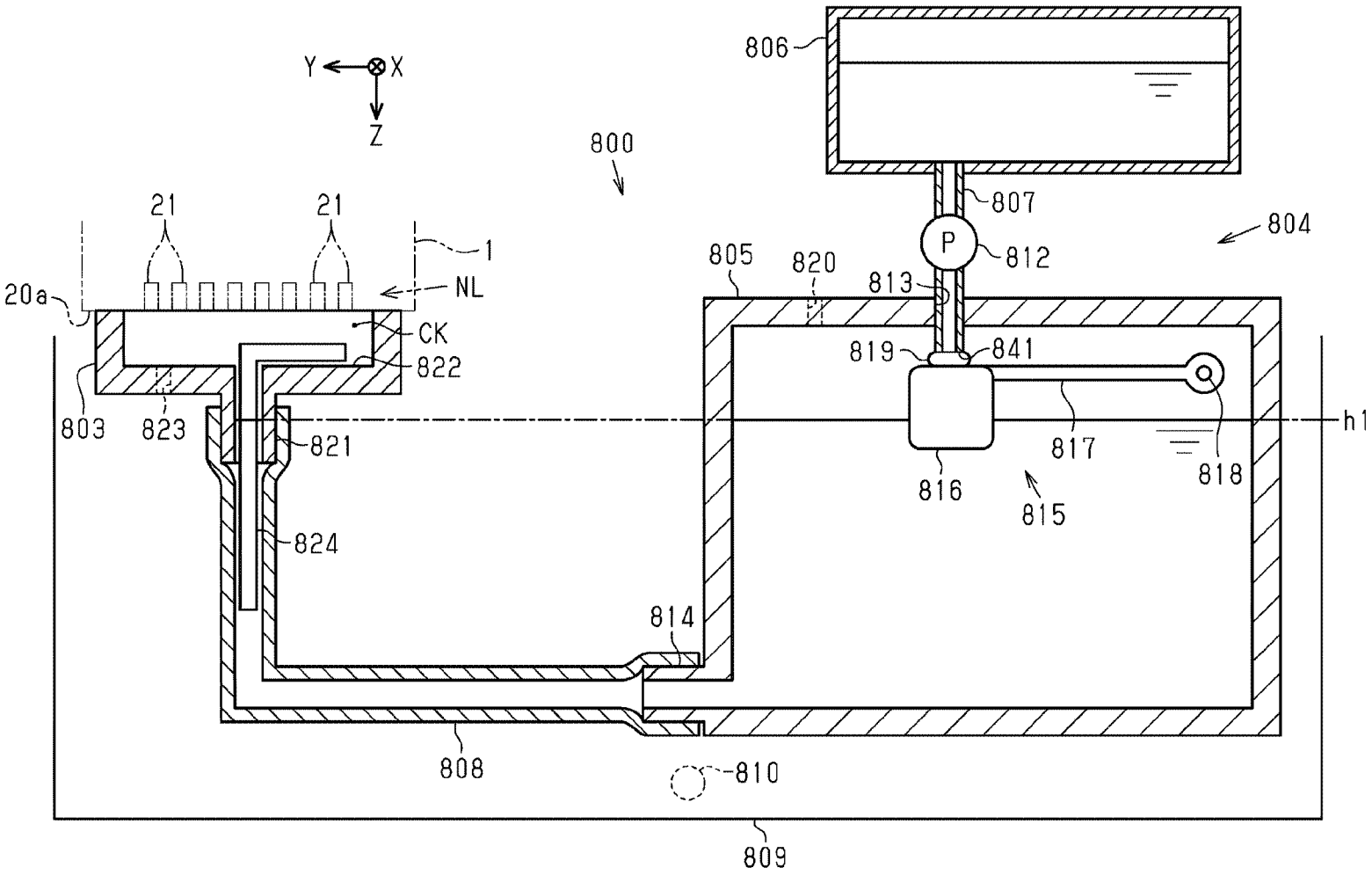
FIG. 13 is a side cross-sectional view schematically illustrating a configuration of the capping device.

As illustrated in FIGS. 12 and 13, the capping device 800 includes a moisturizing liquid supply unit 804 that supplies a moisturizing liquid for moisturizing the nozzles 21 of the liquid ejecting units 1A and 1B to the moisturizing cap 803. The moisturizing liquid supply unit 804 includes a moisturizing liquid storage unit 805 configured to store the moisturizing liquid, a moisturizing liquid accommodation unit 806 configured to accommodate the moisturizing liquid, and a supply flow channel 807 configured to connect the moisturizing liquid storage unit 805 and the moisturizing liquid accommodation unit 806. The moisturizing liquid supply unit 804 is disposed on an upstream side of the moisturizing cap 803 in the transport direction Y. The moisturizing liquid accommodation unit 806 is disposed over the moisturizing liquid storage unit 805 in a vertical direction which coincides with the gravity direction Z. The capping device 800 further includes a connection flow channel 808 configured to connect the moisturizing cap 803 and the moisturizing liquid storage unit 805. Although FIG. 12 illustrates one connection flow channel 808 for each of the moisturizing cap units 801 and 802, practically, four connection flow channels 808 are provided so as to correspond to the number of pieces of the moisturizing caps 803. The total of 8 connection flow channels 808 extend from the moisturizing liquid storage unit 805.

The capping device 800 further includes a holder 809 that holds the moisturizing cap units 801 and 802 (moisturizing caps 803), and the moisturizing liquid storage unit 805. The holder 809 includes a shaft 810 at a portion thereof which is the central portion in the transport direction Y and is downward in the vertical direction. The shaft 810 extends in the scanning direction X. A moisturizing motor 811 for driving the holder 809 is connected to the holder 809. The holder 809 is allowed to be lifted up and down in the vertical direction (gravity direction Z) and to be tilted based on the shaft 810 as the center, by power of the moisturizing motor 811. That is, the moisturizing cap 803 and the moisturizing liquid storage unit 805 are movable in synchronization with each other in the vertical direction by the holder 809. The holder 809 allows the moisturizing cap 803 to move between the contact position being in contact with the liquid ejecting unit 1 in the non-printing area LA and the retreated position separated from the liquid ejecting unit 1.

As illustrated in FIG. 13, in the moisturizing liquid supply unit 804, the supply flow channel 807 constitutes a flow channel for supplying the moisturizing liquid from the moisturizing liquid accommodation unit 806 to the moisturizing liquid storage unit 805. The supply flow channel 807 extends so as to cause the other end thereof on an opposite side of one end as the moisturizing liquid accommodation unit 806 side to be accommodated in the moisturizing liquid storage unit 805. A moisturizing liquid pump 812 is provided at a position in the middle of the supply flow channel 807. The moisturizing liquid pump 812 is used for delivering the moisturizing liquid in the moisturizing liquid accommodation unit 806 to the moisturizing liquid storage unit 805. The moisturizing liquid pump 812 continues generation of predetermined pressure during a period when power of the liquid ejecting apparatus 7 is input, such that the moisturizing liquid accommodated in the moisturizing liquid accommodation unit 806 is moved to the moisturizing liquid storage unit 805.

A hole 813 is provided in an upper portion of the moisturizing liquid storage unit 805. The hole 813 is used for introducing the supply flow channel 807 from the outside of the moisturizing liquid storage unit 805 into the moisturizing liquid storage unit 805. The moisturizing liquid storage unit 805 includes a supply port 814 for supplying the stored moisturizing liquid to the moisturizing cap 803. The moisturizing liquid supply unit 804 in the embodiment has a configuration in which the moisturizing liquid storage unit 805, the moisturizing liquid accommodation unit 806, and the supply flow channel 807 are individually provided, and thus the moisturizing liquid accommodation unit 806 is allowed to be replaced. That is, when a few of the moisturizing liquid in the moisturizing liquid accommodation unit 806 is present, the moisturizing liquid accommodation unit 806 is replaced, and thus replenishment of the moisturizing liquid is possible. In the moisturizing liquid supply unit 804, the moisturizing liquid storage unit 805 and the moisturizing liquid accommodation unit 806 may be integrally provided by the supply flow channel 807. A replenishment port for replenishing the moisturizing liquid may be provided in the moisturizing liquid accommodation unit 806.

A float 815 is provided in the moisturizing liquid storage unit 805. The float 815 includes a buoyancy object 816 and an arm 817. The buoyancy object 816 is configured to float on the moisturizing liquid stored in the moisturizing liquid storage unit 805, by buoyancy of the object 816. The buoyancy object 816 is attached to the tip of the arm 817. In the arm 817, a base end on an opposite side of the tip having the buoyancy object 816 attached thereto is provided to be rotatable by the shaft 818. That is, the buoyancy object 816 is movable in the moisturizing liquid storage unit 805 so as to draw an arc based on the shaft 818 as the center. The float 815 includes a valve portion 819 which is attached to an upper portion of the buoyancy object 816 and is able to open and close the supply flow channel 807. The valve portion 819 operates in accordance with buoyancy of the buoyancy object 816, as follows. The valve portion 819 closes the supply flow channel 807 by pressing on an opening end 841 of the supply flow channel 807 which opens to the inside of the moisturizing liquid storage unit 805. The valve portion 819 opens the supply flow channel 807 by being separated from the opening end 841 of the supply flow channel 807.

Here, if the position of the liquid surface of the moisturizing liquid in the moisturizing liquid storage unit 805 is lowered due to vaporization of the moisturizing liquid stored in the moisturizing liquid storage unit 805, the position of the buoyancy object 816 floating on the moisturizing liquid is also similarly lowered. If the position of the liquid surface of the moisturizing liquid in the moisturizing liquid storage unit 805 rises by a supply of the moisturizing liquid from the moisturizing liquid accommodation unit 806 through the supply flow channel 807, the position of the buoyancy object 816 floating on the moisturizing liquid also similarly rises. That is, the buoyancy object 816 is movable in the vertical direction, in accordance with a change of the position of the liquid surface of the moisturizing liquid stored in the moisturizing liquid storage unit 805.

If the buoyancy object 816 in the moisturizing liquid storage unit 805 moves in the vertical direction, the valve portion 819 also moves in the vertical direction along with the buoyancy object 816, and the supply flow channel 807 is opened or closed. That is, the valve portion 819 moves in the vertical direction with the liquid surface of the moisturizing liquid in the moisturizing liquid storage unit 805 being displaced. Thus, the supply flow channel 807 is opened or closed. Specifically, when the liquid surface of the moisturizing liquid stored in the moisturizing liquid storage unit 805 is positioned at a first position h1 indicated by a dashed line in FIG. 13, the valve portion 819 presses on the opening end 841, and thus the supply flow channel 807 is closed. When the liquid surface of the moisturizing liquid is lower than the first position h1, the valve portion 819 is separated from the opening end 841, and thus the supply flow channel 807 is opened. That is, in a case where the liquid surface of the moisturizing liquid in the moisturizing liquid storage unit 805 is lower than the first position h1, the supply flow channel 807 is opened and the moisturizing liquid is supplied from the moisturizing liquid accommodation unit 806 to the moisturizing liquid storage unit 805. In this manner, if the liquid surface of the moisturizing liquid in the moisturizing liquid storage unit 805 reaches the first position h1, the supply flow channel 807 is closed and the supply of the moisturizing liquid from the moisturizing liquid accommodation unit 806 to the moisturizing liquid storage unit 805 is suspended. Consequentially, the moisturizing liquid supply unit 804 has a configuration of appropriately supplying the moisturizing liquid from the moisturizing liquid accommodation unit 806 such that the liquid surface of the moisturizing liquid stored in the moisturizing liquid storage unit 805 is positioned at the first position h1 in the vertical direction.

A communication portion 820 is provided in the upper portion of the moisturizing liquid storage unit 805. The communication portion 820 is configured to cause the inside of the moisturizing liquid storage unit 805 to communicate with the atmosphere. The communication portion 820 is formed by a fine hole meanderingly extending. The communication portion 820 suppresses the vaporized moisturizing liquid in the moisturizing liquid storage unit 805 from being discharged to the outside of the supply unit 804, and opens the inside of the moisturizing liquid storage unit 805 to the atmosphere.

The connection flow channel 808 configured to connect the moisturizing liquid storage unit 805 and the moisturizing cap 803 has one end which is connected to the supply port 814 of the moisturizing liquid storage unit 805, and the other end which is connected to the introduction port 821 of the moisturizing cap 803. The moisturizing liquid stored in the moisturizing liquid storage unit 805 is supplied to the moisturizing cap 803 through the connection flow channel 808 by a water head difference.

The moisturizing cap 803 moves upwardly along with the moisturizing liquid storage unit 805 by the holder 809, and performs capping of the liquid ejecting unit 1. Thus, a space CK including the nozzles 21 is allowed to be formed. The introduction port 821 connected to the connection flow channel 808 is opened in the internal bottom surface 822 of the moisturizing cap 803, which faces the nozzles 21. An atmospheric communication portion 823 which opens the space CK formed by capping to the atmosphere is provided in the internal bottom surface 822 of the moisturizing cap 803.

A capillary member 824 having a capillary force is disposed in the connection flow channel 808. The capillary member 824 is provided as a finely-cylindrical member, and extends toward the space CK from the inside of the connection flow channel 808. In detail, the capillary member 824 is disposed so as to expose a portion thereof from an end portion which is the moisturizing cap 803 side, in the connection flow channel 808. The capillary member 824 extends along the internal bottom surface 822 passing through the introduction port 821 of the moisturizing cap 803. The capillary member 824 is extended from the introduction port 821 to be bent to an opposite side of a side on which the atmospheric communication portion 823 is provided, in the internal bottom surface 822 of the moisturizing cap 803.

A sponge-like member which has continuous bubbles of several μm to hundreds μm may be employed as the capillary member 824. For example, polyolefin such as EVA or polyethylene is preferably used as the material. The capillary member 824 supplies the moisturizing liquid to the moisturizing cap 803 via the inside of the capillary member 824, by using the capillary force of the capillary member 824. In a case where the capillary member 824 is set to have high liquid repellency, the capillary member 824 may supply the moisturizing liquid to the moisturizing cap 803 via the outside of the capillary member 824, by using a capillary force generated in a gap between the surface of the capillary member 824 and an internal surface of the connection flow channel 808. In this case, an air (air bubbles) in the connection flow channel 808 is discharged to the moisturizing cap 803 side via the inside of the capillary member 824. As described above, the capillary member 824 is provided in the connection flow channel 808, and thus the moisturizing liquid is easily guided to the moisturizing cap 803. Thus, a moisturizing effect in the space CK is improved.

Figure 14:
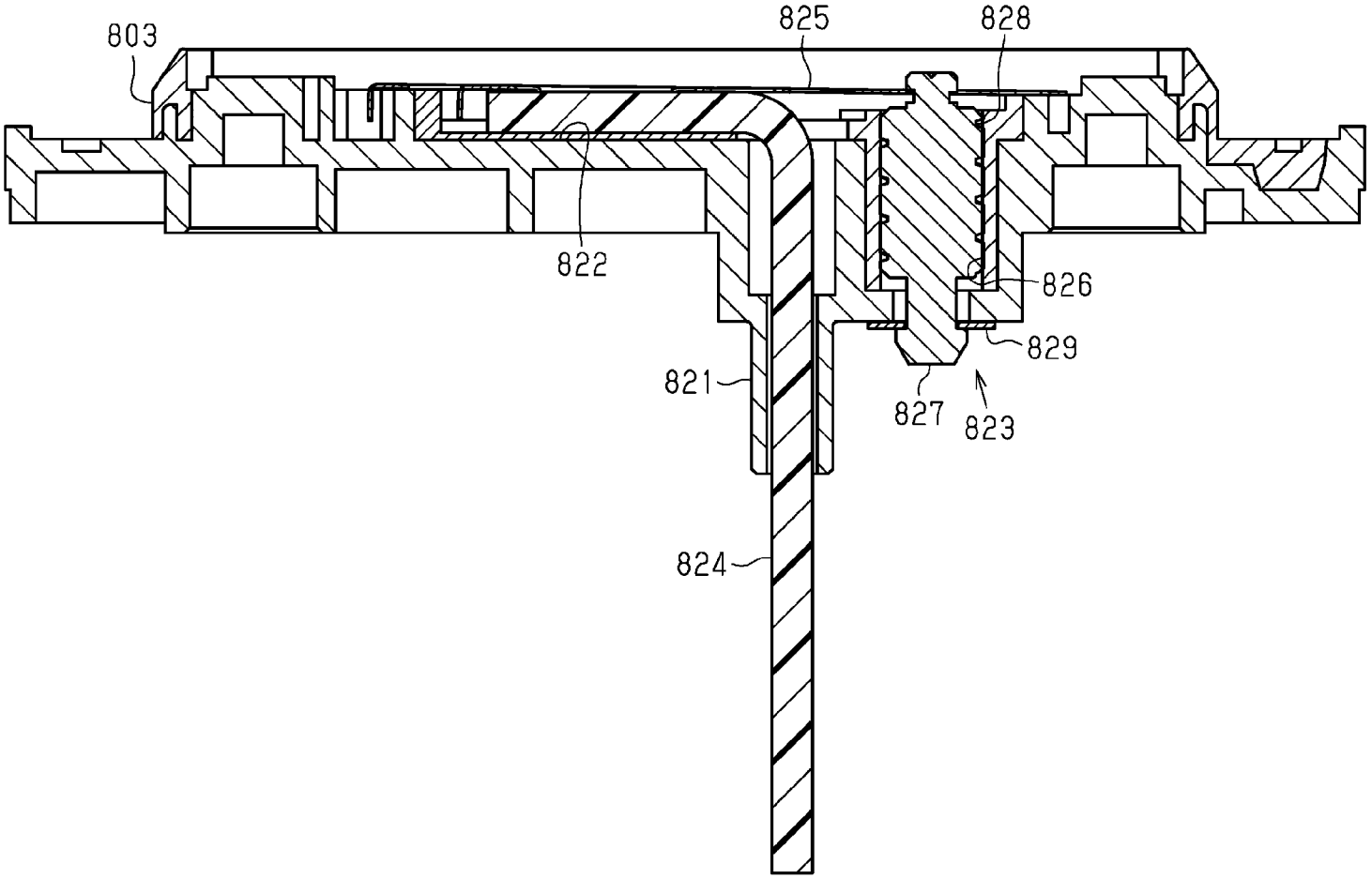
FIG. 14 is a side cross-sectional view of a moisturizing cap.
Figure 15:
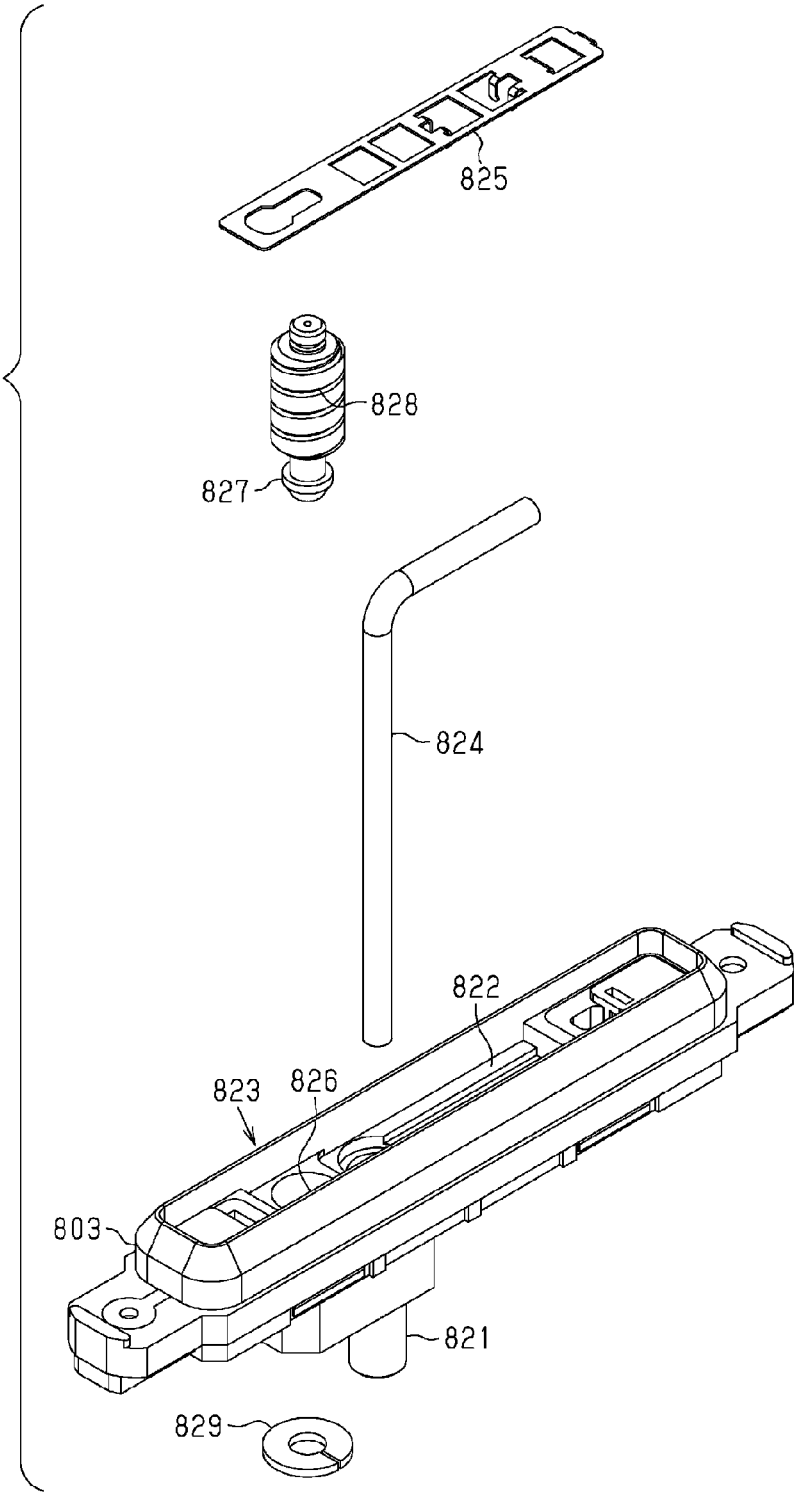
FIG. 15 is an exploded perspective view of the moisturizing cap.

As illustrated in FIGS. 14 and 15, a plate member 825 is provided on the moisturizing cap 803 along the internal bottom surface 822. The plate member 825 causes a portion of the capillary member 824 to be bent along the internal bottom surface 822 of the moisturizing cap 803 and suppresses the capillary member 824 from the upside. The atmospheric communication portion 823 which opens the space CK formed at a time of capping to the atmosphere is configured by inserting (press-fitting) a pin 827 into the through-hole 826 which penetrates the internal bottom surface 822. A fine groove 828 which is spirally extended is formed on an outer peripheral of the pin 827. That is, the space CK is caused to communicate with the atmosphere by passing through a spiral gap (groove 828) formed between an inner peripheral surface of the through-hole 826 and an outer peripheral surface of the pin 827. One end of the pin 827, which is the space CK side, is suppressed by the plate member 825. The other end thereof is held by a washer 829. The atmospheric communication portion 823 opens the space CK of the moisturizing cap 803 to the atmosphere at a time of capping, while suppressing the vaporized moisturizing liquid in the space CK from being discharged to the outside thereof.

As illustrated in FIG. 13, the moisturizing liquid stored in the moisturizing liquid storage unit 805 is supplied to the moisturizing cap 803 through the connection flow channel 808 by a water head difference. Thus, the connection flow channel 808 is filled with the moisturizing liquid up to a position as high as the position of the liquid surface of the moisturizing liquid stored in the moisturizing liquid storage unit 805, in the vertical direction. That is, the moisturizing liquid flows up to the first position h1 in the connection flow channel 808 in the vertical direction. The first position h1 is set to be a position lower than the space CK of the moisturizing cap 803, that is, to be a position lower than the internal bottom surface 822 of the moisturizing cap 803. The capping device 800 in the embodiment is configured so as to cause the position in the disposition region of the capillary member 824 to function as the first position h1 in the connection flow channel 808. The moisturizing liquid with which the connection flow channel 808 is filled up to the first position h1 is vaporized, and the space CK of the moisturizing cap 803 is full with the vaporized moisturizing liquid. Thus, drying of the nozzles 21 is suppressed. Even if the liquid surface of the moisturizing liquid is lowered by vaporization, the moisturizing effect in the space CK is maintained because the moisturizing liquid supply unit 804 appropriately supplies the moisturizing liquid in accordance with the displacement of the liquid surface of the moisturizing liquid.

It is preferable that the moisturizing liquid which is used in the capping device 800 in this manner be the same as the main solvent of an ink used by the liquid ejecting apparatus 7. In the embodiment, since a water-based resin ink in which the solvent of an ink is water is employed, pure water is used as the moisturizing liquid. However, for example, in a case where the solvent of an ink is a solvent, it is preferable that the same solvent as that of the ink be used as the moisturizing liquid. A liquid in which a preservative is contained in pure water may be used as the moisturizing liquid.

It is preferable that the preservative contained in the moisturizing liquid be the same as a preservative contained in the ink. Examples thereof include aromatic halogen compounds (for example, Preventol CMK), methylene dithiocyanate, halogen-containing nitrogen sulfide compounds, and 1,2-benzisothiazolin-3-one (for example, PROXEL GXL). In a case of employing PROXEL as the preservative from the viewpoint of foaming difficulty, it is preferable that the content with respect to the moisturizing liquid be equal to or less than 0.05 mass %.

Electrical Configuration of Liquid Ejecting Apparatus

Next, an electrical configuration of the liquid ejecting apparatus 7 will be described.

As illustrated in FIG. 16, the liquid ejecting apparatus 7 includes a controller 830 that integrally controls the liquid ejecting apparatus 7. The controller 830 is electrically connected to a linear encoder 831. The linear encoder 831 includes a tape-like code disc and a sensor. The code disc is provided so as to extend along the guide shaft 722 to the rear surface side of the carriage 723 illustrated in FIG. 1. The sensor is fixed to the carriage 723 and detects light passing through a slit with a fixed pitch piercing the code disc.

The controller 830 grasps the position of the printing unit 720 in the scanning direction X in a manner that pulses of a number in proportion to the movement amount of the printing unit 720 shown in FIG. 1 are input from the linear encoder 831, and the number of pulses input thereto is added when the printing unit 720 is separated from the home position HP (see FIG. 2) and is subtracted when the printing unit 720 approaches the home position HP.

The controller 830 is electrically connected to the actuator 130 through the driving circuit 832 and controls driving of the actuator 130. The controller 830 grasps clogging in each of the nozzles 21 based on the period of residual vibration of the diaphragm 50 due to the driving of the actuator 130.

The controller 830 is electrically connected to the moisturizing motor 811, the carriage motor 748, the transport motor 749, the wiping motor 753, the flushing motor 754, and the capping motor 755 through motor driving circuits 833, 834, 835, 836, 837, and 838, respectively. The controller 830 controls driving of each of the motors 811, 748, 749, 753, 754, and 755.

The controller 830 is electrically connected to the suction pump 773 and the moisturizing liquid pump 812 through pump driving circuits 839 and 840, respectively. The controller 830 controls driving of pumps 773 and 812, respectively.

Operation by Maintenance Device

Next, an action of the maintenance device 710 included in the liquid ejecting apparatus 7 will be described particularly focusing on the capping device 800.

When printing data is input to the controller 830 through an external device or the like, the controller 830 drives the carriage motor 748 based on the printing data and controls the printing unit 720 to eject ink droplets toward the surface of the medium ST from each nozzle 21 of the liquid ejecting units 1A and 1B while the printing unit 720 moves in the scanning direction X. Then, the ejected ink droplets are landed on the surface of the medium ST, and thus an image or the like is printed on the surface of the medium ST.

During printing of the medium ST, the printing unit 720 moves to the receiving region FA and performs flushing of ejecting and discharging ink droplets from all of the nozzles 21, for a predetermined time period (for example, each time a predetermined time period within a range of 10 to 30 seconds elapses). The above-described operation is performed for the purpose of preventing thickening or the like of an ink in the nozzle 21 which does not eject ink droplets among all of the nozzles 21.

If predetermined suction cleaning conditions are satisfied, the controller 830 controls the carriage motor 748 to move the printing unit 720 to the home position HP, and performs suction cleaning. The suction cleaning is performed as follows. The suction pump 773 is driven in a state where a sealed space is formed by bringing the suction cap 770 into contact with the liquid ejecting unit 1 so as to surround the nozzle line NL. Thus, negative pressure acts on the inside of the suction cap 770. Accordingly, a predetermined amount of an ink is sucked from the nozzles 21 and thus a thickened ink, air bubbles, or the like are removed.

After the suction cleaning is finished, the controller 830 moves the printing unit 720 to the wiping area WA and controls the wiping member 750*a* to perform wiping in which the liquid ejecting unit 1 is wiped. Thus, droplets or the like discharged from the nozzles 21 and adhering to the liquid ejecting unit 1 are removed. After the wiping is performed, the controller 830 moves the printing unit 720 to the receiving area FA and performs flushing for the liquid receiving portion 751*a*. Thus, the controller 830 sets the meniscus in the nozzle 21.

Then, the controller 830 detects clogging in each of the nozzles 21 based on the period of residual vibration of the diaphragm 50 due to the driving of the actuator 130. Here, clogging of each of the nozzles 21 is detected after the suction cleaning is finished. The reason is because, particularly in a case where a resin ink including a synthetic resin which is cured by heating or a UV ink which is cured by irradiation with UV (ultraviolet ray) is used as the ink, the nozzle 21 for which clogging is not resolved even if suction cleaning is performed may be present. "Clogging" referred herein includes not only a state where an ink in the nozzle 21 is solidified and jammed, but also a state where normal discharging (ejection) of the ink from the nozzle 21 is not possible due to the ink hardening so that the film pulls on the meniscus in the nozzle 21 or the ink thickening in the nozzle 21, in the pressure generating chamber 12, and in the nozzle communication path 16.

If being in a print job wait state in a case where clogging is not detected in all of the nozzles 21, the controller 830 controls the printing unit 720 to move to the printing area PA and to perform printing on the medium ST. If printing on the medium ST is finished and a wait state where an input of a new print job waits occurs, the controller 830 controls the printing unit 720 to move to the non-printing area LA and controls the liquid ejecting unit 1 to be capped by the moisturizing cap 803, and thus performs moisturizing of the nozzle 21 in order to suppress an ink in the nozzle 21 from being solidified by drying.

As illustrated in FIG. 13, when moisturizing of the nozzle 21 is performed by the moisturizing cap 803, the amount of the vaporized moisturizing liquid is increased or the temperature of the surroundings is increased, and thus air pressure in the space CK including the nozzle 21 may be increased. For example, in a case where the space CK is a closed space, an expanded air or the vaporized moisturizing liquid in the space CK flows in the nozzle 21, and thus the meniscus of an ink in the nozzle 21 may be damaged. At this point, in the capping device 800 in the embodiment, the moisturizing cap 803 includes the atmospheric communication portion 823. Thus, it is possible to maintain the air pressure in the space CK to be substantially the same as the atmospheric pressure.

When the nozzle 21 is moisturized by the moisturizing cap 803, an ink may be dropped from the nozzle 21. In this case, the dropped ink adheres to the opening of the atmospheric communication portion 823 of the moisturizing cap 803, which is on the space CK side. Thus, the groove 828 provided in the pin 827 may be blocked. As described above, in a case where the space CK of the moisturizing cap 803 does not communicate with the atmosphere, there is a concern that the meniscus of an ink in the nozzle 21 is damaged, and performing suitable moisturizing is not possible. Thus, the capping device 800 in the embodiment is configured so as to allow removal of the ink adhering to the opening of the atmospheric communication portion 823 on the space CK side, in this case. That is, the controller 830 drives the moisturizing motor 811 so as to tilt the holder 809 at a predetermined timing. It is preferable that this operation be performed when the moisturizing cap 803 is positioned at the retreated position of being separated from the liquid ejecting unit 1.

Figure 17:
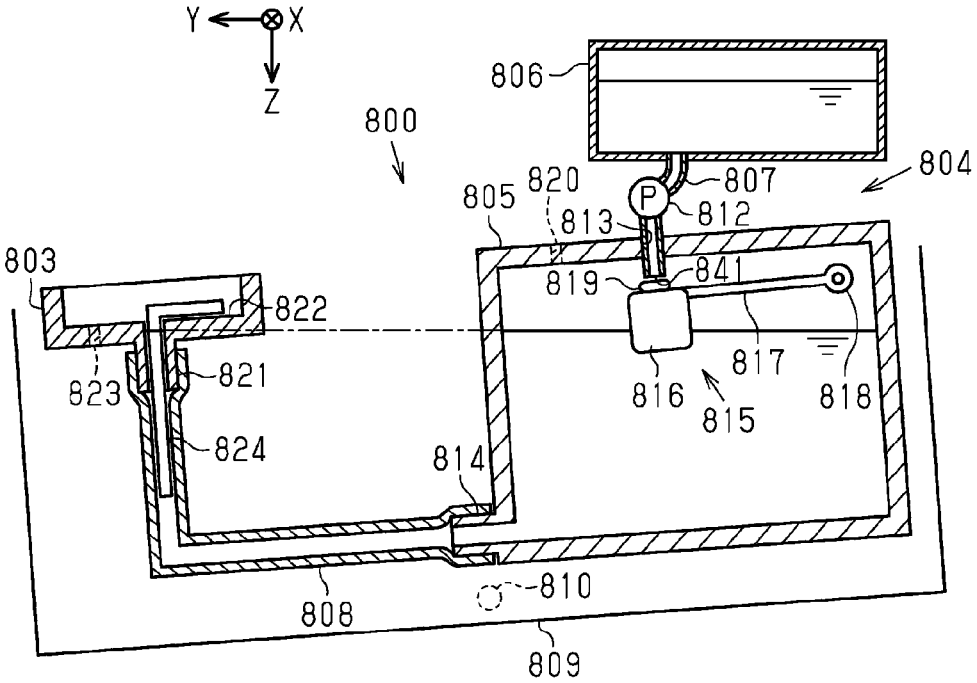
FIG. 17 is a side cross-sectional view of the capping device illustrating a position of a liquid surface of a moisturizing liquid when the moisturizing liquid is displaced from a horizontal state to an inclined state by a holder.

As illustrated in FIG. 17, in the capping device 800, the holder 809 is tilted based on the shaft 810 as the center, and thus is changed from a horizontal state to an inclined state illustrated in FIG. 13. Specifically, the holder 809 is tilted counterclockwise based on the shaft 810 as the center in FIG. 17, such that the moisturizing cap 803 moves downward and the moisturizing liquid storage unit 805 moves upward in the vertical direction. If the holder 809 is tilted, the moisturizing cap 803 is positioned at a position relatively lower than the moisturizing liquid storage unit 805 in the capping device 800 in the inclined state, in comparison to a case where the capping device 800 is in the horizontal state. Thus, the moisturizing liquid stored in the moisturizing liquid storage unit 805 flows into the moisturizing cap 803 side. Thus, the amount of the moisturizing liquid stored in the moisturizing liquid storage unit 805 is reduced by an amount of the moisturizing liquid flowing into the moisturizing cap 803 side. That is, the holder 809 is tilted and thus the positional relationship between the moisturizing cap 803 and the moisturizing liquid storage unit 805 in the vertical direction is changed. The position of the liquid surface of the moisturizing liquid in the moisturizing liquid storage unit 805 is changed in accordance with the change of the positional relationship. At this time, the buoyancy object 816 constituting the float 815 moves downward in accordance with the displacement of the liquid surface of the moisturizing liquid. Thus, the valve portion 819 is separated from the opening end 841 of the supply flow channel 807 and the moisturizing liquid is supplied from the moisturizing liquid accommodation unit 806 to the moisturizing liquid storage unit 805.

Figure 18:
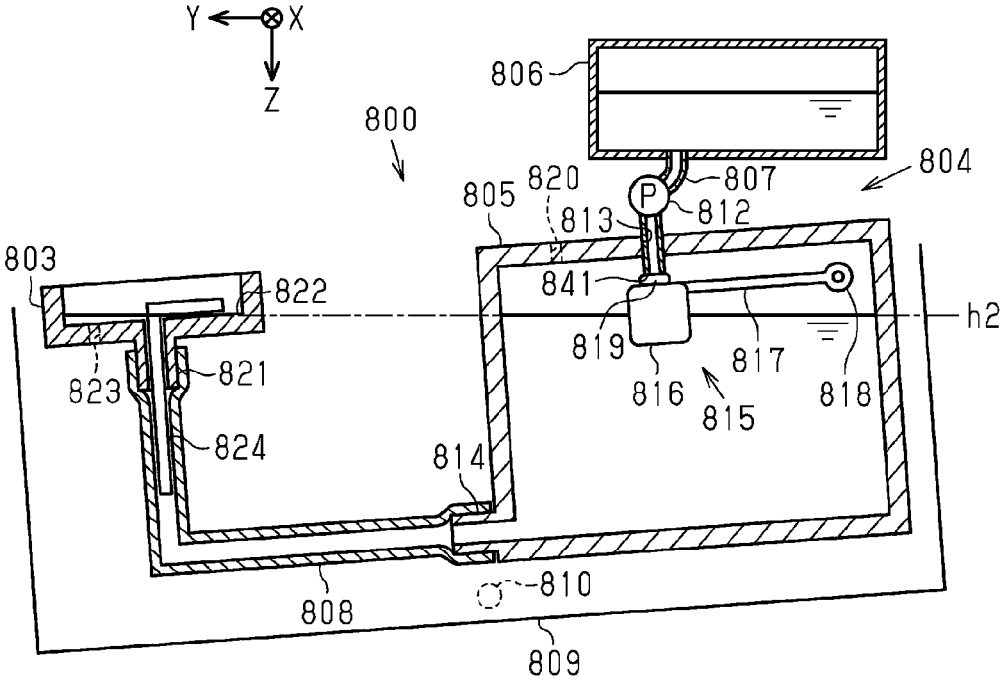
FIG. 18 is a side cross-sectional view of the capping device illustrating the position of the liquid surface of the moisturizing liquid in the inclined state.

As illustrated in FIG. 18, in the capping device 800 in the inclined state, if the moisturizing liquid is supplied from the moisturizing liquid accommodation unit 806 to the moisturizing liquid storage unit 805 through the supply flow channel 807, the position of the liquid surface of the moisturizing liquid in the moisturizing liquid storage unit 805 is increased. Simultaneously, the liquid surface of the moisturizing liquid on the moisturizing cap 803 side is also increased. The buoyancy object 816 is lifted up in accordance with the increase of the position of the liquid surface of the moisturizing liquid in the moisturizing liquid storage unit 805, and the supply flow channel 807 is closed by the valve portion 819. At this time, the position of the liquid surface of the moisturizing liquid in the moisturizing liquid storage unit 805 is a second position h2 which is a position higher than the opening of the atmospheric communication portion 823 on the space CK side, which is provided in the internal bottom surface 822 of the moisturizing cap 803 in the vertical direction. That is, the capping device 800 is displaced to be in the inclined state by the holder 809, and thus the moisturizing liquid reaches the opening of the atmospheric communication portion 823 on the space CK side, which is provided in the moisturizing cap 803. Thus, the ink adhering to the atmospheric communication portion 823 is dissolved in the moisturizing liquid, and thus the ink can be removed. Accordingly, the moisturizing liquid supply unit 804 supplies the moisturizing liquid from the moisturizing liquid accommodation unit 806 so as to cause the liquid surface of the moisturizing liquid stored in the moisturizing liquid storage unit 805 to be the second position h2 in the vertical direction.

Figure 19:
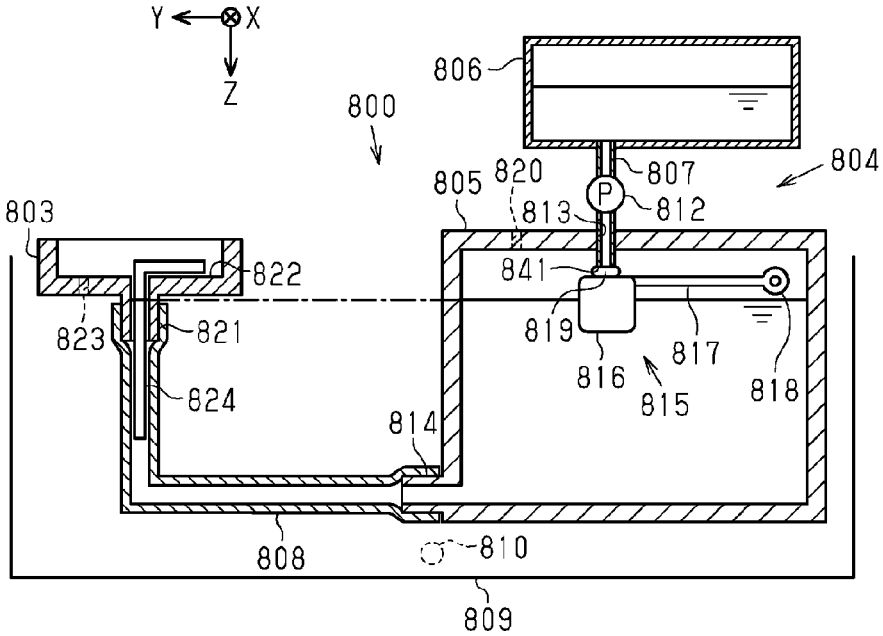
FIG. 19 is a side cross-sectional view of the capping device illustrating the position of the liquid surface of the moisturizing liquid when the moisturizing liquid is brought back to the horizontal state from the inclined state by the holder.

As illustrated in FIG. 19, if the position of the liquid surface of the moisturizing liquid in the moisturizing liquid storage unit 805 is the second position h2 and the supply flow channel 807 is closed by the valve portion 819, the holder 809 is tilted based on the shaft 810 as the center (tilted in a clockwise direction in FIG. 18), and thus the capping device 800 is changed from the inclined state to the horizontal state. If the capping device 800 is changed, the moisturizing liquid flowing into the moisturizing cap 803 side is brought back to the moisturizing liquid storage unit 805. Thus, the amount of the moisturizing liquid stored in the moisturizing liquid storage unit 805 is increased by the amount of the moisturizing liquid brought back from the moisturizing cap 803 side. That is, the holder 809 is tilted and thus the positional relationship between the moisturizing cap 803 and the moisturizing liquid storage unit 805 in the vertical direction is changed. The position of the liquid surface of the moisturizing liquid in the moisturizing liquid storage unit 805 is changed in accordance with the change of the positional relationship. At this time, the position of the liquid surface of the moisturizing liquid stored in the moisturizing liquid storage unit 805 is higher than the first position h1 but lower than the internal bottom surface 822 of the moisturizing cap 803. As described above, the ink removed by the moisturizing liquid is brought back to the moisturizing liquid storage unit 805 side, and thus clogging of the atmospheric communication portion 823 is released.

According to the first embodiment, the following effects can be obtained.

(1) For example, even though the temperature of the surrounding is increased and thus a gas in the space CK formed by the moisturizing cap 803 is expanded, a probability of damaging the meniscus of an ink in the nozzle 21 is reduced because the space CK communicates with the atmosphere by the atmospheric communication portion 823. Accordingly, it is possible to suitably moisturize the liquid ejecting unit 1 that ejects an ink.

(2) Since the first position h1 which is the position of the liquid surface of the moisturizing liquid stored in the moisturizing liquid storage unit 805 is lower than the space CK of the moisturizing cap 803 in the vertical direction, it is possible to reduce a probability of adhesion of the moisturizing liquid to the liquid ejecting unit even though the moisturizing liquid is spattered by vibration and the like from an outside of the capping device.

(3) It is possible to improve the moisturizing effect in the space CK by the capillary member 824 having a capillary force.

(4) The moisturizing cap 803 and the moisturizing liquid storage unit 805 are provided to be movable in synchronization with each other in the vertical direction. Thus, for example, in a case where the moisturizing cap 803 required to form the space CK including the nozzle 21 approaches the liquid ejecting unit 1, the moisturizing liquid storage unit 805 also similarly moves. Thus, it is possible to hold the positional relationship between the moisturizing cap 803 and the moisturizing liquid storage unit 805 in the vertical direction, and to maintain the position of the liquid surface of the moisturizing liquid to be constant.

(5) The moisturizing liquid supply unit 804 supplies the moisturizing liquid so as to cause the liquid surface of the moisturizing liquid in the moisturizing liquid storage unit 805 to be a second position h2 higher than the opening of the atmospheric communication portion 823 on the space CK side. Thus, for example, even if an ink dropped from the nozzle 21 adheres to the opening of the atmospheric communication portion 823 on the space CK side, and the atmospheric communication portion 823 is clogged, the moisturizing liquid is caused to reach the opening of the atmospheric communication portion 823 on the space CK side, and thus it is possible to remove the adhering ink by using the moisturizing liquid.

(6) When the buoyancy object 816 moves in accordance with the change of the position of the liquid surface of the moisturizing liquid stored in the moisturizing liquid storage unit 805, the valve portion 819 included in the buoyancy object 816 also moves. Thus, the supply flow channel 807 is opened or closed. That is, for example, the supply flow channel 807 is opened by the valve portion 819 when the liquid surface of the moisturizing liquid stored in the moisturizing liquid storage unit 805 is lowered, and thus the moisturizing liquid supply unit 804 can supply the moisturizing liquid so as to cause the liquid surface of the moisturizing liquid stored in the moisturizing liquid storage unit 805 to be constant.

(7) The capillary member 824 is provided in the connection flow channel 808, a probability of the connection flow channel 808 being blocked by air bubbles is reduced.

Second Embodiment

Next, a second embodiment of the capping device 800 will be described with reference to the drawings.

Since configurations to which the same reference numerals at the first embodiment are applied in the second embodiment include the same configurations as the first embodiment, description thereof will be omitted, and description below will be made focusing on difference points from the first embodiment.

Figure 20:
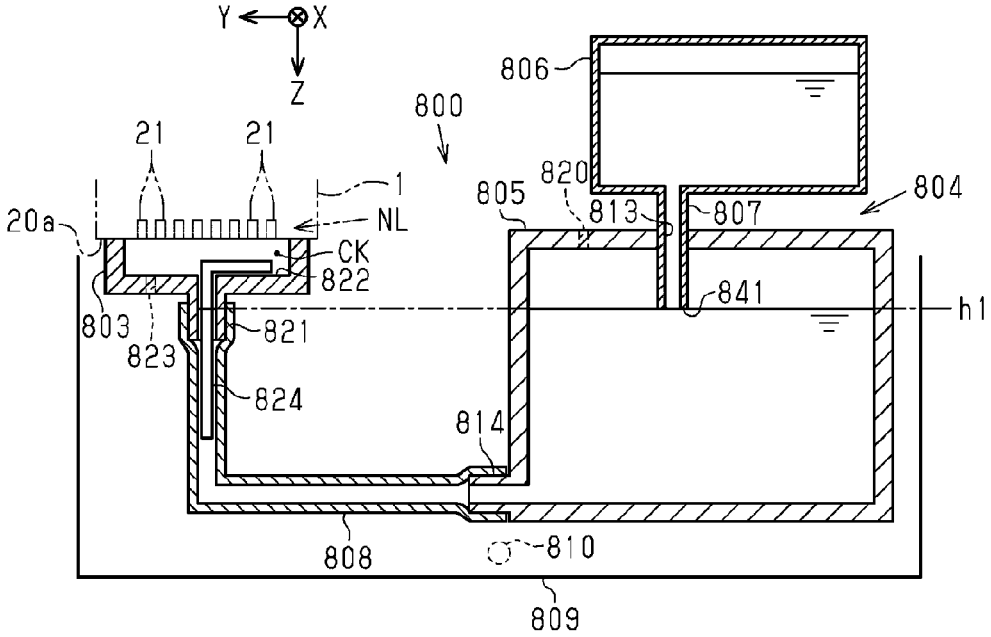
FIG. 20 is a side cross-sectional view illustrating a configuration of a capping device according to a second embodiment.

As illustrated in FIG. 20, the capping device 800 in the second embodiment has a configuration in which the moisturizing liquid pump 812 for delivering the moisturizing liquid from the moisturizing liquid accommodation unit 806 to the moisturizing liquid storage unit 805, and the float 815 for opening or closing the supply flow channel 807 are not provided, in comparison to the first embodiment. In the capping device 800 in the second embodiment, the supply flow channel 807 is provided to be integrated with the moisturizing liquid accommodation unit 806. That is, the moisturizing liquid supply unit 804 in the second embodiment has a configuration of supplying the moisturizing liquid from the moisturizing liquid accommodation unit 806 to the moisturizing liquid storage unit 805 by a water head difference. The moisturizing liquid accommodation unit 806 is disposed so as to cause the opening end 841 of the supply flow channel 807, which opens in the moisturizing liquid storage unit 805 to be the same position (first position h1) as that of the liquid surface of the moisturizing liquid stored in the moisturizing liquid storage unit 805, in the vertical direction.

Here, the moisturizing liquid accommodation unit 806 is closed except for the opening end 841 of the supply flow channel 807. Thus, a situation in which the moisturizing liquid flows down from the moisturizing liquid accommodation unit 806 to the moisturizing liquid storage unit 805 does not occur as long as the opening end 841 is in contact with the liquid surface of the moisturizing liquid in the moisturizing liquid storage unit 805. Meanwhile, if the liquid surface is lowered, for example, by vaporizing the moisturizing liquid stored in the moisturizing liquid storage unit 805 and the opening end 841 of the supply flow channel 807 is opened to a gas (air or vaporized moisturizing liquid) in the moisturizing liquid storage unit 805, the gas flows in from the opening end 841 and the moisturizing liquid flows down from the moisturizing liquid accommodation unit 806 to the moisturizing liquid storage unit 805. If the liquid surface of the moisturizing liquid stored in the moisturizing liquid storage unit 805 returns to the first position h1, the liquid surface of the moisturizing liquid in the moisturizing liquid storage unit 805 comes into contact with the opening end 841 of the supply flow channel 807, and the supply of the moisturizing liquid from the moisturizing liquid accommodation unit 806 is suspended. That is, the moisturizing liquid supply unit 804 in the second embodiment supplies the moisturizing liquid so as to maintain the liquid surface of the moisturizing liquid stored in the moisturizing liquid storage unit 805 to be the same position as that of the opening end 841 of the supply flow channel 807. In other words, in the capping device 800 in the second embodiment, the position of the liquid surface of the moisturizing liquid stored in the moisturizing liquid storage unit 805 is determined by the position of the opening end 841 of the supply flow channel 807. Thus, the capping device 800 in the second embodiment is configured to cause the opening end 841 of the supply flow channel 807 to be positioned at the position (first position h1) lower than the space CK of the moisturizing cap 803 in the vertical direction.

Figure 21:
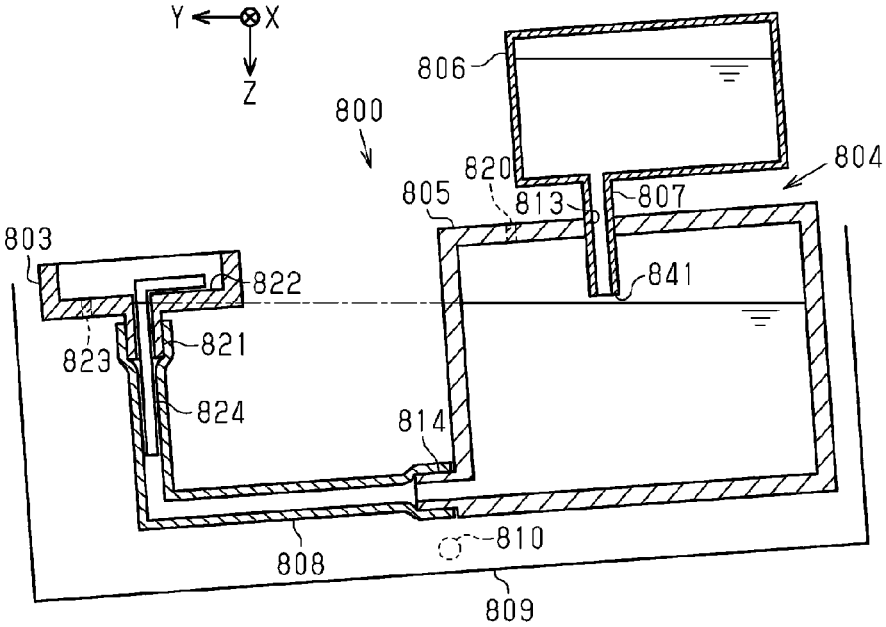
FIG. 21 is a side cross-sectional view of the capping device illustrating the position of the liquid surface of the moisturizing liquid when the moisturizing liquid is displaced from the horizontal state to the inclined state by the holder.
Figure 22:
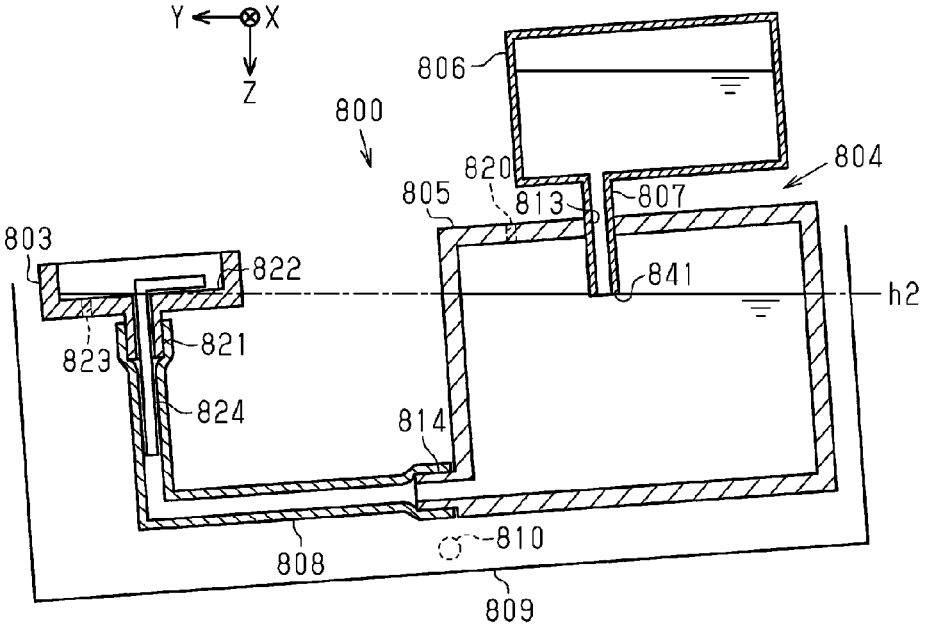
FIG. 22 is a side cross-sectional view of the capping device illustrating the position of the liquid surface of the moisturizing liquid in the inclined state.
Figure 23:
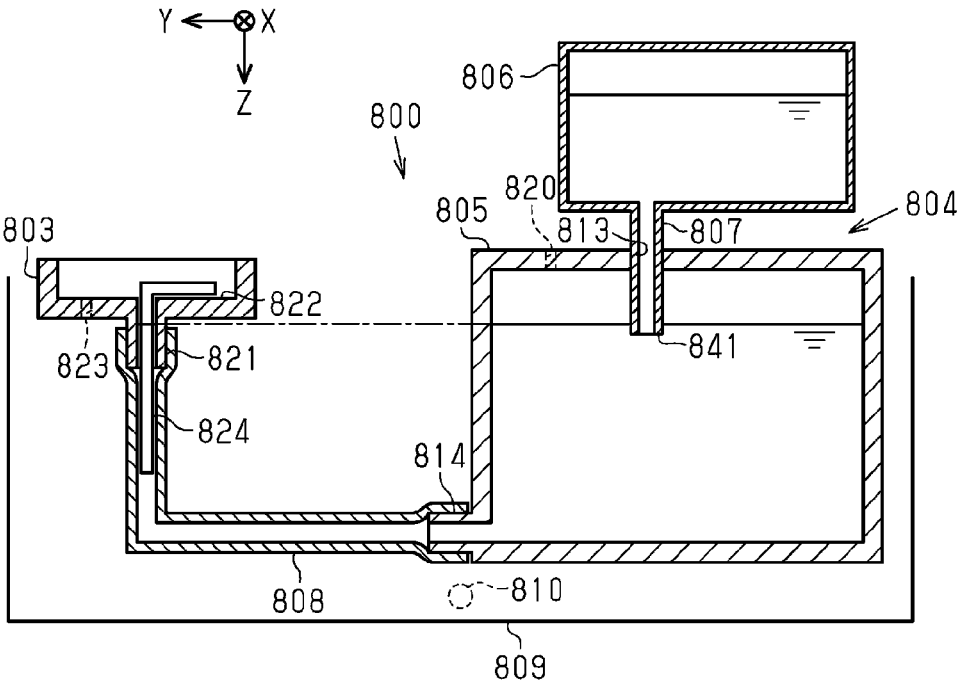
FIG. 23 is a side cross-sectional view of the capping device illustrating the position of the liquid surface of the moisturizing liquid when the moisturizing liquid is brought back to the horizontal state from the inclined state by the holder.

As illustrated in FIGS. 21 to 23, in the capping device 800 in the second embodiment, an operation when an ink adhering to the opening of the atmospheric communication portion 823 on the space CK side, which is provided in the moisturizing cap 803 is removed is similar to the operation in the first embodiment, which is illustrated in FIGS. 15 to 17. Similar to that in the first embodiment, in the capping device 800 in the second embodiment, the position of the liquid surface of the moisturizing liquid stored in the moisturizing liquid storage unit 805 is changed between the first position h1 and the second position h2 in accordance with the tilt of the holder 809. Thus, it is possible to remove the ink adhering to the atmospheric communication portion 823 of the moisturizing cap 803.

According to the second embodiment, the following effects can be obtained in addition to the above-described effects of (1) to (5) and (7).

(8) The moisturizing liquid is supplied from the moisturizing liquid accommodation unit 806 to the moisturizing liquid storage unit 805 by the water head difference, and thus the moisturizing liquid is supplied so as to cause the liquid surface of the moisturizing liquid stored in the moisturizing liquid storage unit 805 to be the same position as that of the opening end 841 of the supply flow channel 807. That is, the moisturizing liquid supply unit 804 can supply the moisturizing liquid so as to hold the liquid surface of the moisturizing liquid stored in the moisturizing liquid storage unit 805 to be constant.

(9) Since the moisturizing liquid is supplied from the moisturizing liquid accommodation unit 806 to the moisturizing liquid storage unit 805 by the water head difference, the moisturizing liquid supply unit 804 supplies the moisturizing liquid so as to cause the liquid surface of the moisturizing liquid in the moisturizing liquid storage unit 805 to be the first position h1 even in a state where the power of the liquid ejecting apparatus 7 is not input. That is, it is possible to suitably moisturize the nozzle 21 even in a state where the power is not input.

Each of the embodiments may be modified as in modification examples which will be described below. Each of the above embodiments and the following modification examples may be arbitrarily combined and used.

Figure 24:
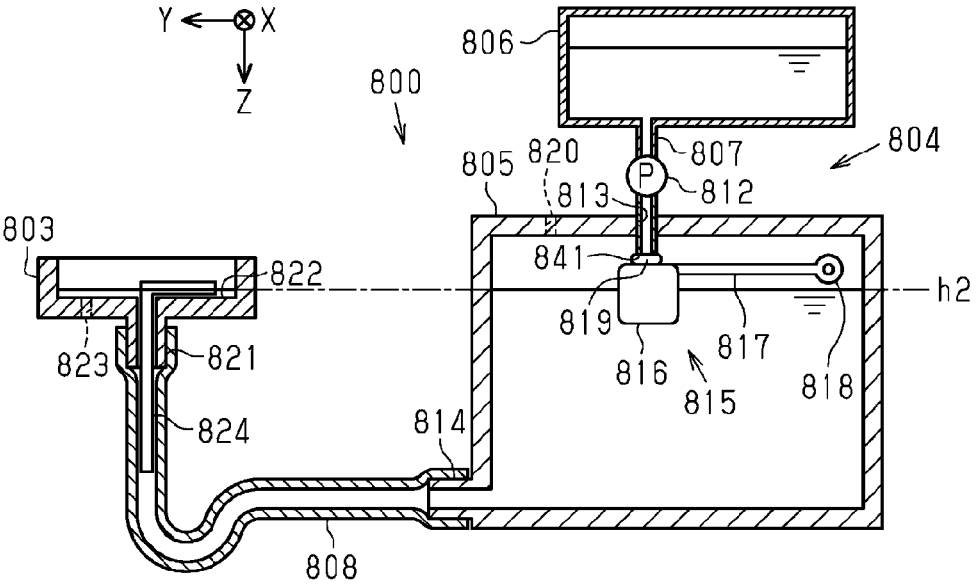
FIG. 24 is a side cross-sectional view illustrating a modification example of the capping device in the first embodiment.

As illustrated in FIG. 24, the first embodiment may have a configuration in which each of the moisturizing caps 803 is set to independently movable in the vertical direction, and thus the liquid surface of the moisturizing liquid is changed between the first position h1 and the second position h2. According to the modification example, the position with respect to the moisturizing liquid storage unit 805 is changed for each of the moisturizing caps 803. Thus, it is possible to individually release clogging of the atmospheric communication portion 823. The moisturizing liquid storage unit 805 may have a configuration of being movable to the moisturizing cap 803 in the vertical direction. In the above-described modification example, the holder 809 may be not provided.

In the first embodiment, an electromagnetic valve for opening or closing the supply flow channel 807 may be provided instead of the float 815. In this case, driving of the electromagnetic valve for opening or closing is controlled so as to cause the liquid surface of the moisturizing liquid stored in the moisturizing liquid storage unit 805 to be the first position h1.

In the first embodiment, the moisturizing liquid supply unit 804 may be provided so as to supply the moisturizing liquid from the moisturizing liquid accommodation unit 806 to the moisturizing liquid storage unit 805 only by the water head difference as in the second embodiment.

In each of the embodiments, the capping device 800 may have a configuration of not following the supply of the moisturizing liquid from the moisturizing liquid accommodation unit 806 to the moisturizing liquid storage unit 805 when the position of the liquid surface of the moisturizing liquid stored in the moisturizing liquid storage unit 805 is changed between the first position h1 and the second position h2. It is possible to change the position of the liquid surface of the moisturizing liquid only by changing the positional relationship between the moisturizing cap 803 and the moisturizing liquid storage unit 805 in the vertical direction.

In each of the embodiments, the capping device 800 may include a separate controller. In this case, driving of the moisturizing motor 811, the moisturizing liquid pump 812, or the like in the capping device 800 is controlled by the controller included in the capping device 800.

In each of the embodiments, the capillary member 824 may be provided over the total length of the connection flow channel 808.

In each of the embodiments, the capillary member 824 may not be a cylindrical member as long as the capillary member 824 is allowed to be disposed in the connection flow channel 808. The capillary member 824 may be a belt-like member having a polygonal cross-section or be a member having a circular tube shape.

In each of the embodiments, the moisturizing liquid supply unit 804 may have a configuration of supplying the moisturizing liquid from the moisturizing liquid accommodation unit 806 to the moisturizing liquid storage unit 805 only by pressure which is caused by the pump. In this case, the supply is performed without considering the water head difference between the moisturizing liquid storage unit 805 and the moisturizing liquid accommodation unit 806. Thus, the variance of the disposition of the moisturizing liquid accommodation unit 806 is improved. In this modification example, driving of the pump is controlled so as to cause the liquid surface of the moisturizing liquid stored in the moisturizing liquid storage unit 805 to be the first position h1.

In each of the embodiments, the opening end 841 of the supply flow channel 807 may open to an inner wall of the moisturizing liquid storage unit 805.

In each of the embodiments, the atmospheric communication portion 823 may be provided at a side wall portion of the moisturizing cap 803. According to this modification example, even if the first position h1 is a position higher than the internal bottom surface 822 of the moisturizing cap 803, a situation in which the atmospheric communication portion 823 is blocked by the moisturizing liquid does not occur. The first position h1 is preferably a position lower than the nozzle 21 of the liquid ejecting unit 1.

In each of the embodiments, an on-off valve configured to allow opening and closing of the connection flow channel 808 may be provided at a position in the middle of the connection flow channel 808. According to this modification example, the on-off valve is closed, for example, when the capping device 800 is carried. Thus, it is possible to reduce a probability of spilling the moisturizing liquid through the moisturizing cap 803 by an impact and the like.

In each of the embodiments, the moisturizing cap 803 may be provided so as to allow capping of all of the nozzles 21 in the liquid ejecting unit 1.

In each of the embodiments, a plurality of moisturizing liquid supply units 804 may be provided for each of the moisturizing caps 803.

In each of the embodiments, a wiper configured to wipe the liquid ejecting surface 20*a* of the liquid ejecting units 1A and 1B may be separately provided between the capping device 800 in the non-printing area LA and the printing area PA.

In each of the embodiments, in a case where the nozzle 21 in which clogging is not resolved even when the controller 830 performs suction cleaning a predetermined number of times based on a clogging detection history, so-called complementary printing in which printing is performed while ejecting ink instead with another normal nozzle 21, without using the nozzle 21 in which clogging is not resolved may be temporarily performed.

In each of the embodiments, a liquid ejected by the liquid ejecting unit 1 is not limited to an ink. For example, the liquid may be a liquid body or the like in which particles of a functional material are dispersed or mixed in a liquid. For example, a configuration may be made in which recording is performed while ejecting a liquid body including an electrode material or coloring material (pixel material) or the like in a dispersed or dissolved form. The electrode material or coloring material is used in the manufacturing or the like of a liquid crystal display, EL (electroluminescence) display, and a surface emitting display, for example.

In each of the embodiments, the medium is not limited to a sheet, and may be a plastic film, a thin plate material, or the like, or may be a fabric used in textile printing or the like.

In the first embodiment, the on-and-off valve that opens or closes the supply flow channel 807 by pressing a pressed portion on the supply flow channel 807 may be provided or the on-and-off valve may be opened or closed by using movement of the float 815. For example, a pressing portion configured to pressing on the pressed portion of the on-and-off valve may be provided at a position on an opposite side of the buoyancy object 816 with respect to the shaft 818 of the arm 817 of the float 815. If the position of the liquid surface of the moisturizing liquid in the moisturizing liquid storage unit 805 is lowered, the position of the pressing portion rises and thus the pressed portion may be pressed and the on-and-off valve may be opened or closed.

In the first embodiment, when the operation of the moisturizing cap 803 coming into contact with the liquid ejecting unit and performing the capping is not performed, a cover member configured to cover the opening portion of the moisturizing cap 803 may be provided.

Next, the ink (colored ink) as the liquid ejected by the liquid ejecting unit 1 will be described in detail below.

The ink used in the liquid ejecting apparatus 7 contains a resin with the above constitution, and does not substantially contain glycerin with a boiling point at one atmosphere of 290° C. If the ink substantially includes glycerin, the drying properties of the ink significantly decrease. As a result, in various media, in particular, in a medium which is non-absorbent or has low absorbency to ink, not only light and dark unevenness in the image is noticeable, but also fixing properties of the ink are not obtained. It is preferable that the ink do not substantially include alkyl polyols (except the above glycerin) having a boiling point corresponding to one atmosphere is 280° C. or higher.

Here, the wording "does not substantially include" in the specification means that an amount or more which sufficiently exhibits the meaning of adding is not contained. To put this quantitatively, it is preferable that glycerin be not included at 1.0 mass % or more with respect to the total mass (100 mass %) of the ink. Not including 0.5 mass % or more is more preferable, not including 0.1 mass % or more is further preferable, not including 0.05 mass % or more is even more preferable, and not including 0.01 mass % or more is particularly preferable. It is most preferable that 0.001 mass % or more of glycerin be not included.

Next, additives (components) which are included in or may be included in the ink will be described.

1. Coloring Material

The ink may contain a coloring material. The coloring material is selected from a pigment and a dye.

1-1. Pigment

It is possible to improve light resistance of the ink by using a pigment as the coloring material. Either of an inorganic pigment or an organic pigment may be used as the pigment. Although not particularly limited, examples of the inorganic pigment include carbon black, iron oxide, titanium oxide and silica oxide.

Although not particularly limited, examples of the organic pigment include quinacridone-based pigments, quinacridonequinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketo-pyrrolo-pyrrole-based pigments, perinone-based pigments, quinophthalone-based pigments, anthraquinone-based pigments, thioindigo-based pigments, benzimidazolone-based pigments, isoindolinone-based pigments, azomethine-based pigments and azo-based pigments. Specific examples of the organic pigment include substances as follows.

Examples of the pigment used in the cyan ink include C.I. Pigment Blue 1, 2, 3, 15, 15:1, 15:2, 15:3, 15:4, 15:6, 15:34, 16, 18, 22, 60, 65, and 66, and C.I. Vat Blue 4 and 60. Among these substances, either of C.I. Pigment Blue 15:3 and 15:4 is preferable.

Examples of the pigment used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violet 19, 23, 32, 33, 36, 38, 43, and 50. Among these substances, one type or more selected from a group consisting of C.I. Pigment Red 122, C.I. Pigment Red 202, and C.I. Pigment Violet 19 are preferable.

Examples of the pigment used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among these substances, one type or more selected from a group consisting of C.I. Pigment Yellow 74, 155, and 213 are preferable.

Examples of pigments used in other colors of ink, such as green ink and orange ink, include pigments known in the related art.

It is preferable that the average particle diameter of the pigment be equal to or less than 250 nm in order to be able to suppress clogging in the nozzle 21 and to cause the discharge stability to be more favorable. The average particle diameter in the specification is volumetric basis. As a measurement method, for example, it is possible to perform measurement with a particle size distribution analyzer in which a laser diffraction scattering method is the measurement principle. Examples of the particle size distribution analyzer include a particle size distribution meter (for example, Microtrac UPA manufactured by Nikkiso Co., Ltd.) in which dynamic light scattering is the measurement principle.

1-2. Dye

A dye may be used as the coloring material. Although not particularly limited, acid dyes, direct dyes, reactive dyes, and basic dyes can be used as the dye. The content of the coloring material is preferably 0.4 to 12 mass % with respect to the total mass (100 mass %) of the ink, and is more preferably 2 mass % to 5 mass %.

2. Resin

The ink contains a resin. The ink contains a resin, and thus a resin film is formed on a medium. As a result, the ink is sufficiently fixed on the medium, and an effect of favorable abrasion resistance of the image is mainly exhibited. Thus, the resin emulsion is preferably a thermoplastic resin. The thermal deformation temperature of the resin is preferably equal to or higher than 40° C. andmore preferably equal to or higher than 60° C., in order to obtain advantageous effects in that clogging of the nozzle 21 does not easily occur, and the abrasion resistance of the medium is maintained.

Here, "thermal deformation temperature" in the specification is set to be a temperature value represented by the glass-transition temperature (Tg) or the minimum film forming temperature (MFT). That is, "a thermal deformation temperature of 40° C. or higher" means that either of the Tg or the MFT may be 40° C. or higher. Since the MFT is superior to the Tg for easily grasping redispersibility of the resin, the thermal deformation temperature is preferably the temperature value represented by the MFT. If the ink is excellent in redispersibility of the resin, the nozzle 21 is not easily clogged because the ink is not fixed.

Although not particularly limited, examples of the thermoplastic resin include (meth)acrylic polymers, such as poly(meth)acrylic ester or copolymers thereof, polyacrylonitrile or copolymers thereof, polycyanoacrylate, polyacrylamide, and poly(meth)acrylic acid, polyolefin-based polymers, such as polyethylene, polypropylene, polybutene, polyisobutylene, polystyrene and copolymers thereof, petroleum resins, coumarone-indene resins and terpene resins; vinyl acetate or vinyl alcohol polymers, such as polyvinyl acetate or copolymers thereof, polyvinyl alcohol, polyvinyl acetal, and polyvinyl ether; halogen-containing polymers, such as polyvinyl chloride or copolymers thereof, polyvinylidene chloride, fluororesins and fluororubbers; nitrogen-containing vinyl polymers, such as polyvinyl carbazole, polyvinylpyrrolidone or copolymers thereof, polyvinylpyridine, or polyvinylimidazole; diene based polymers, such as polybutadiene or copolymers thereof, polychloroprene and polyisoprene (butyl rubber); and other ring-opening polymerization type resins, condensation polymerization-type resins and natural macromolecular resins.

The content of the resin is preferably 1 to 30 mass % with respect to the total mass (100 mass %) of the ink, and 1 to 5 mass % is more preferable. In a case where the content is in the above-described range, it is possible further improve glossiness and abrasion resistance of the coated image to be formed. Examples of the resin which may be included in the ink include a resin dispersant, a resin emulsion, and a wax.

2-1. Resin Emulsion

The ink may contain a resin emulsion. The resin emulsion forms a resin coating film preferably along with a wax (emulsion) when the medium is heated, and thus the ink is sufficiently fixed onto the medium. Thus, the resin emulsion exhibits an effect of improving abrasion resistance of the image. In a case of printing the medium with an ink which contains a resin emulsion according to the above effects, the ink has particularly excellent abrasion resistance on a medium which is non-absorbent or has low absorbency to ink.

The resin emulsion which functions as a binder is contained in the ink, in an emulsion state. The resin which functions as the binder is contained in the ink in the emulsion state, and thus it is possible to easily adjust the viscosity of the ink to an appropriate range in an ink jet recording method, and to improve the storage stability and discharge stability of the ink.

Although not limited to the following, examples of the resin emulsion include simple polymers or copolymers of (meth) acrylate, (meth)acrylic ester, acrylonitrile, cyanoacrylate, acrylamide, olefin, styrene, vinyl acetate, vinyl chloride, vinyl alcohol, vinyl ethyl, vinyl pyrrolidone, vinyl pyridine, vinyl carbazole, vinyl imidazole, and vinylidene chloride, fluororesins, and natural resins. Among these substances, either of a methacrylic resin and a styrene-methacrylate copolymer resin is preferable, either of an acrylic resin and a styrene-acrylate copolymer resin is more preferable, and a styrene-acrylate copolymer resin is still more preferable. The above copolymers may have a form of any of random copolymers, block copolymers, alternating copolymers, and graft copolymers.

The average particle diameter of the resin emulsion is preferably in a range of 5 nm to 400 nm, and more preferably in a range 20 nm to 300 nm, in order to further improve the storage stability and recording stability of the ink. The content of the resin emulsion among the resins is preferably in a range of 0.5 to 7 mass % to the total mass (100 mass %) of the ink. If the content is in the above range, it is possible to reduce the solid content concentration, and to further improve the discharge stability.

2-2. Wax

The ink may contain a wax. The ink contains the wax, and thus fixability of the ink on a medium which is non-absorbent or with low absorbency to ink is more excellent. Among these, it is preferable that the wax be an emulsion type. Although not limited to the following, examples of the wax include a polyethylene wax, a paraffin wax, and a polyolefin wax, and among these, a polyethylene wax, described later, is preferable. In the specification, the "wax" mainly means a substance in which solid wax particles are dispersed in water using a surfactant which will be described later.

The ink contains a polyethylene wax, and thus it is possible to improve the abrasion resistance of the ink. The average particle diameter of a polyethylene wax is in a range of 5 nm to 400 nm, and more preferably in a range 50 nm to 200 nm, in order to further improve the storage stability and recording stability of the ink.

The content (solid content conversion) of the polyethylene wax is independently of one another and is in a range of 0.1 to 3 mass % with respect to the total content (100 mass %) of the ink. A range of 0.3 to 3 mass % is more preferable, and a range of 0.3 to 1.5 mass % is further preferable. If the content is in the above ranges, it is possible to favorably solidify and fix the ink even on a medium that is non-absorbent or with low absorbency to ink, and it is possible to further improve the storage stability and discharge stability of the ink.

3. Surfactant

The ink may contain a surfactant. Although not limited to the following, examples of the surfactant include nonionic surfactants. The nonionic surfactant has an action of evenly spreading the ink on the medium. Thus, in a case where printing is performed by using an ink including the nonionic surfactant, a high definition image with very little bleeding is obtained. Although not limited to the following, examples of such a nonionic surfactant include silicon-based, polyoxyethylene alkylether-based, polyoxypropylene alkylether-based, polycyclic phenyl ether-based, sorbitan derivative and fluorine-based surfactants, and among these a silicon-based surfactant is preferable.

The content of the surfactant is preferably in a range of 0.1 mass % to 3 mass % with respect to the total content (100 mass %) of the ink, in order to further improve the storage stability and discharge stability of the ink.

4. Organic Solvent

The ink may include a known volatile water-soluble organic solvent. As described above, it is preferable that the ink do not substantially contain glycerin (boiling point at 1 atmosphere of 290° C.) which is one type of an organic solvent, and do not substantially contain alkyl polyols (excluding glycerin) having a boiling point corresponding to one atmosphere of 280° C. or higher.

5. Aprotic Polar Solvent

The ink may contain an aprotic polar solvent. The ink contains an aprotic polar solvent, and thus the above-described resin particles included in the ink are dissolved. Accordingly, it is possible to effectively suppress clogging of the nozzles 21 at a time of printing. Since the aprotic polar solvent has properties of dissolving a medium such as vinyl chloride, adhesiveness of an image is improved.

Although not particularly limited, the aprotic polar solvent preferably includes one type or more selected from pyrrolidones, lactones, sulfoxides, imidazolidinones, sulfolanes, urea derivatives, dialkylamides, cyclic ethers, and amide ethers. Representative examples of the pyrrolidone include 2-pyrrolidone, N-methyl-2-pyrrolidone, and N-ethyl-2-pyrrolidone. Representative examples of the lactone include γ-butyrolactone, γ-valerolactone, and ε-caprolactone. Representative examples of the sulfoxide include dimethyl sulfoxide, and tetramethylene sufloxide.

Representative examples of the imidazolidinone include 1,3-dimethyl-2-imidazolidinone. Representative examples of the sulfolane include sulfolane, and dimethyl sulfolane. Representative examples of the urea derivative include dimethyl urea and 1,1,3,3-tetramethyl urea. Representative examples of the dialkylamide include dimethyl formamide and dimethylacetamide. Representative examples of the cyclic ether include 1,4-dioxsane, and tetrahydrofuran.

Among these substances, pyrrolidones, lactones, sulfoxides and amide ethers, are particularly preferable from a viewpoint of the above-described effects, and 2-pyrrolidone is the most preferable. The content of the above-described aprotic polar solvent is preferably in a range of 3 to 30 mass % with respect to the total mass (100 mass %) of the ink, and is more preferably in a range of 8 to 20 mass %.

6. Other Components

The ink may further include a fungicide, an antirust agent, a chelating agent, and the like in addition to the above components.

Next, the components of the surfactant mixed into the moisturizing liquid will be described.

As the surfactant, cationic surfactants such as alkylamine salts and quaternary ammonium salts; anionic surfactant such as dialkyl sulfosuccinate salts, alkylnaphthalenesulfonic acid salts and fatty acid salts; amphoteric surfactants, such as alkyl dimethyl amine oxide, and alkylcarboxybetaine; nonionic surfactants such as polyoxyethylene alkyl ethers, polyoxyethylene alkyl allyl ethers, acetylene glycols, and polyoxyethylene-polyoxypropylene block copolymers may be used. Among these substances, particularly, anionic surfactants or nonionic surfactants are preferable.

The content of the surfactant is preferably 0.1 to 5.0 mass % with respect to the total mass of the moisturizing liquid. The content of the surfactant is preferably 0.5 to 1.5 mass % with respect to the total content of the moisturizing liquid, from a viewpoint of foamabilty and defoaming properties after forming air bubbles. The surfactant may be used singly or in a combination of two or more. It is preferable that the surfactant contained in the moisturizing liquid be the same as the surfactant contained in the ink (liquid). For example, in a case where the surfactant contained in the ink (liquid) is a nonionic surfactant, although not limited to the following, examples of nonionic surfactants include silicon-based surfactants, polyoxy ethylene alkylether-based surfactants, polyoxy propylene alkyl ether-based surfactants, polycyclic phenyl ether-based surfactants, sorbitan derivatives, and fluorine-based surfactants. Among these substances, silicon-based surfactants are preferable.

In particular, it is preferable that an adduct in which 4 to 30 added mols of ethyleneoxide (EO) are added to acetylene diol be used as the surfactant, in order that the heights of foams directly after foaming and after five minutes elapses from the foaming, which are obtained by using the Ross Miles method are set to be in the above range (foam height directly after foaming is equal to or higher than 50 mm, and foam height after five minutes elapses from the foaming is equal to or lower than 5 mm). It is preferable that the content of the adduct be 0.1 to 3.0 weight % with respect to the total weight of a cleaning solution. Further, it is preferable that an adduct in which 10 to 20 added mols of ethyleneoxide (EO) are added to acetylene diol be used as the surfactant, in order that the heights of foams directly after foaming and after five minutes elapses from the foaming, which are obtained by using the Ross Miles method is set to be in the above range (foam height directly after foaming is equal to or higher than 100 mm, and foam height after five minutes elapses from the foaming is equal to or lower than 5 mm). It is preferable that the content of the adduct be 0.5 to 1.5 weight % with respect to the total weight of the cleaning solution. If the content of the ethyleneoxide adduct of acetylene diol is excessively high, there is a concern of reaching the critical micelle concentration and forming an emulsion.

The surfactant has a function of causing wetting and spreading of the aqueous ink on a recording medium to be easily performed. The surfactants able to be used in the invention are not particularly limited, and examples thereof include anionic surfactants such as dialkyl sulfosuccinate salts, alkyl naphthalene sulfosuccinate salts, fatty acid salts; nonionic surfactants such as polyoxyethylene alkyl ethers, polyoxyethylene alkyl allyl ethers, acetylene glycols, and polyoxyethylene-polyoxypropylene block copolymers; cationic surfactants such as alkyl amine salts and quaternary ammonium salts; silicone-based surfactants, and fluorine-based surfactants.

The surfactant has an effect of causing aggregations to be divided and dispersed by a surface activity effect between the moisturizing liquid and the aggregation. Because of the ability to lower the surface tension of the cleaning solution, there is an effect that the cleaning solution easily performs infiltration between the aggregation and a liquid ejecting surface 20*a*, and the aggregation is easily peeled from the liquid ejecting surface 20*a*.

It is possible to suitably use any surfactant as long as the compound has a hydrophilic portion and a hydrophobic portion in the same molecule. Specific examples thereof preferably include compounds represented by Formulas (I) to (IV). That is, examples include a polyoxyethylene alkyl phenyl ether-based surfactant in Formula (I), an acetylene glycol-based surfactant in Formula (II), a polyoxyehtylene-alkyl ether-based surfactants in Formula (III), and a polyoxyethylene polyoxypropylenealkyl ether-based surfactants in Formula (IV).

(I)

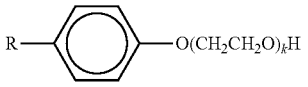

(R is a hydrocarbon chain which has 6 to 14 carbon atoms and may be branched, and k:5 to 20)

(II)

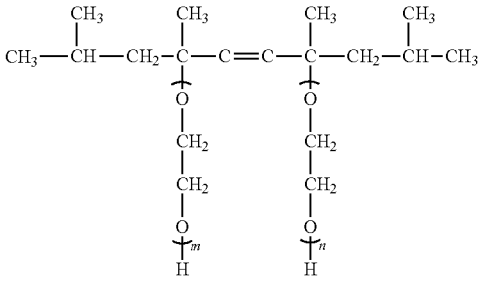

(m and n≤20, 0<m+n≤40)

$$R—(OCH_2CH_2)nH \quad (III)$$

(R is a hydrocarbon chain which has 6 to 14 carbon atoms and may be branched, and n:5 to 20)

(IV)

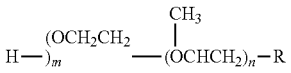

(R is a hydrocarbon chain having 6 to 14 carbon atoms and m and n are numerals of 20 or lower)

The followings may be used as the surfactant in addition to the compounds in Formulas (I) to (IV): alkyl and aryl ethers of polyhydric alcohols such as diethylene glycol monophenyl ether, ethylene glycol monophenyl ether, ethylene glycol monoallyl ether, diethylene glycol monophenyl ether, diethylene glycol mono-butyl ether, propylene glycol mono-butyl ether, and tetraethylene glycol chlorophenyl ether, nonionic surfactants such as polyoxyethylene polyoxypropylene block copolymers and fluorine-based surfactants, and lower alcohols such as ethanol and 2-propanol. In particular, diethylene glycol monobutyl ether is preferable.

The entire disclosure of Japanese Patent Application No. 2016-150173, filed Jul. 29, 2016 is expressly incorporated by reference herein.

What is claimed is:

1. A capping device comprising:

a moisturizing cap which is brought into contact with a liquid ejecting unit configured to eject a liquid from a nozzle so as to allow forming of a space including the nozzle;

a connection flow channel which is connected to the moisturizing cap; and a moisturizing liquid supply unit which is connected to the connection flow channel and that is configured to supply a moisturizing liquid to a moisturizing liquid storage unit that is configured to to store the moisturizing liquid, the moisturizing liquid supply unit supplying the moisturizing liquid to the moisturizing liquid storage unit so as to cause a liquid surface of the moisturizing liquid in the moisturizing liquid storage unit to be at a position, wherein the moisturizing cap includes an atmospheric communication portion configured to open the space to an atmosphere, wherein the moisturizing liquid supply unit includes a moisturizing liquid accommodation unit configured to accommodate the moisturizing liquid, a supply flow channel for supplying the moisturizing liquid in the moisturizing liquid accommodation unit to the moisturizing liquid storage unit, and a buoyancy object which is movable in accordance with a change of a position of the liquid surface of the moisturizing liquid in the moisturizing liquid storage unit and includes a valve portion which allows opening and closing of the supply flow channel.

2. The capping device according to claim 1, wherein the moisturizing liquid supply unit supplies the moisturizing liquid to the moisturizing liquid storage unit so as to cause the position to be lower than that of the space in a vertical direction.

3. The capping device according to claim 1, further comprising:

a capillary member which has a capillary force and is disposed to be extended from an inside of the connection flow channel into the space, wherein the moisturizing liquid supply unit supplies the moisturizing liquid to the moisturizing liquid storage unit so as to cause the position to be positioned in a disposition region of the capillary member in the vertical direction.

4. The capping device according to claim 1, wherein the moisturizing cap and the moisturizing liquid storage unit are provided to be movable in synchronization with each other in the vertical direction.

5. The capping device according to claim 1, wherein the moisturizing liquid supply unit allows a supply of the moisturizing liquid to the moisturizing liquid storage unit, so as to cause the liquid surface of the moisturizing liquid in the moisturizing liquid storage unit to be a second position which is higher than an opening of the atmospheric communication portion on the space side in the vertical direction.

6. The capping device according to claim 1, wherein the moisturizing liquid supply unit includes a moisturizing liquid accommodation unit configured to accommodate the moisturizing liquid, and a supply flow channel for supplying the moisturizing liquid in the moisturizing liquid accommodation unit to the moisturizing liquid storage unit, and an opening end of the supply flow channel which opens in the moisturizing liquid storage unit is disposed at a position which is the same as the position in the vertical direction.

7. A liquid ejecting apparatus comprising:

a liquid ejecting unit configured to eject a liquid from a nozzle;

a moisturizing cap which is brought into contact with the liquid ejecting unit so as to allow forming of a space including the nozzle;

a connection flow channel which is connected to the moisturizing cap; and a moisturizing liquid supply unit which is connected to the connection flow channel and that is configured to supply a moisturizing liquid to a moisturizing liquid storage unit that is configured to to store the moisturizing liquid, the moisturizing liquid supply unit supplying the moisturizing liquid to the moisturizing liquid storage unit so as to cause a liquid surface of the moisturizing liquid in the moisturizing liquid storage unit to be at a position, wherein the moisturizing cap includes an atmospheric communication portion configured to open the space to an atmosphere, wherein the moisturizing liquid supply unit includes a moisturizing liquid accommodation unit configured to accommodate the moisturizing liquid, a supply flow channel for supplying the moisturizing liquid in the moisturizing liquid accommodation unit to the moisturizing liquid storage unit, and a buoyancy object which is movable in accordance with a change of a position of the liquid surface of the moisturizing liquid in the moisturizing liquid storage unit and includes a valve portion which allows opening and closing of the supply flow channel.

8. The liquid ejecting apparatus according to claim 7, further comprising:

a capillary member which has a capillary force and is disposed to be extended from an inside of the connection flow channel into the space, wherein the moisturizing liquid supply unit supplies the moisturizing liquid to the moisturizing liquid storage unit so as to cause the position to be positioned in a disposition region of the capillary member in the vertical direction.

9. A liquid ejecting apparatus comprising:

a liquid ejecting unit configured to eject a liquid from a nozzle;

a moisturizing cap which is brought into contact with the liquid ejecting unit so as to allow forming of a space including the nozzle;

a connection flow channel which is connected to the moisturizing cap; and a moisturizing liquid supply unit which is connected to the connection flow channel and that is configured to supply a moisturizing liquid toward the moisturizing cap, wherein the moisturizing cap includes an atmospheric communication portion configured to open the space to an atmosphere, wherein the moisturizing liquid supply unit supplies the moisturizing liquid toward the moisturizing cap, so as to cause a liquid surface of the moisturizing liquid in the moisturizing cap to be a position which is higher than an opening of the atmospheric communication portion on the space side.

10. The liquid ejecting apparatus according to claim 9, further comprising:

a capillary member which has a capillary force and is disposed to be extended from an inside of the connection flow channel into the space, wherein the moisturizing liquid supply unit supplies the moisturizing liquid toward the moisturizing cap so as to cause the liquid surface of the moisturizing liquid to be positioned in a disposition region of the capillary member.

11. The liquid ejecting apparatus according to claim 9, wherein the disposition region is lower than an internal bottom surface of the moisturizing cap.

* * * * *